US011613456B2

(12) United States Patent
Joshi et al.

(10) Patent No.: US 11,613,456 B2
(45) Date of Patent: Mar. 28, 2023

(54) PROACTIVE DISPENSER TO OPERATOR MOBILE ALERT SYSTEM

(71) Applicant: The Coca-Cola Company, Atlanta, GA (US)

(72) Inventors: Udayan Joshi, Atlanta, GA (US); Marc Katz, Atlanta, GA (US); Matthew Arnwine, Atlanta, GA (US); Scott Harrison, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 17/404,922

(22) Filed: Aug. 17, 2021

(65) Prior Publication Data

US 2022/0106182 A1 Apr. 7, 2022

Related U.S. Application Data

(63) Continuation of application No. 16/331,385, filed as application No. PCT/US2017/050732 on Sep. 8, 2017, now Pat. No. 11,091,361.

(Continued)

(51) Int. Cl.

| | |
|---|---|
| ***B67D 1/08*** | (2006.01) |
| ***G07F 9/02*** | (2006.01) |
| ***G07F 13/06*** | (2006.01) |

(52) U.S. Cl.

CPC ..... *B67D 1/0888* (2013.01); *B67D 1/0871* (2013.01); *G07F 9/026* (2013.01); *G07F 13/065* (2013.01)

(58) Field of Classification Search

CPC .. B67D 1/0888; B67D 1/0871; B67D 1/0022; G07F 9/026; G07F 13/065

See application file for complete search history.

(56) References Cited

U.S. PATENT DOCUMENTS

2006/0020487 A1 1/2006 Spittel et al.
2007/0050083 A1 * 3/2007 Signorelli ..... G07F 9/026 700/241

(Continued)

FOREIGN PATENT DOCUMENTS

WO WO-2011094625 A1 * 8/2011 ..... G06Q 30/02
WO WO-2013/056744 A1 4/2013
WO WO-2015/101573 A1 7/2015

OTHER PUBLICATIONS

Extended European Search Report on EP 17849636.0 dated Apr. 24, 2020, 11 pgs.

(Continued)

*Primary Examiner* — Donnell A Long
(74) *Attorney, Agent, or Firm* — Foley & Lardner LLP

(57) ABSTRACT

A consumable item dispenser and method may include an ingredient storage unit configured to store a consumable ingredient used to produce consumable items by the dispenser. A sensor may be configured to sense an amount of consumable ingredient remaining to be dispensed. An input/output unit may be configured to communicate data over a communications network. A processing unit may be in communication with the sensor, and be configured to authenticate an electronic device associated with an operator and register the electronic device associated with the operator. A determination as to whether an amount of the ingredient in the ingredient storage unit is at or below a threshold level. The processing unit may generate a notification indicative that the ingredient is at or below a threshold level, and communicate the notification to the operator in response to being generated.

20 Claims, 18 Drawing Sheets

Related U.S. Application Data

(60) Provisional application No. 62/385,160, filed on Sep. 8, 2016.

(56) References Cited

U.S. PATENT DOCUMENTS

| | | | | |
|---|---|---|---|---|
| 2007/0083287 | A1* | 4/2007 | Defosse | G07F 19/211 700/236 |
| 2014/0089077 | A1 | 3/2014 | Zuckerman et al. | |
| 2014/0150669 | A1* | 6/2014 | Green | B67D 1/0021 99/323.2 |
| 2014/0154382 | A1* | 6/2014 | Green | G06Q 50/28 426/477 |
| 2015/0105880 | A1 | 4/2015 | Slupik et al. | |
| 2015/0142621 | A1 | 5/2015 | Gray et al. | |
| 2015/0339621 | A1 | 11/2015 | Hewett et al. | |
| 2016/0081365 | A1 | 3/2016 | Bertone | |
| 2016/0090288 | A1 | 3/2016 | Givens et al. | |
| 2016/0244311 | A1 | 8/2016 | Burks et al. | |
| 2016/0297666 | A1 | 10/2016 | Guy et al. | |
| 2018/0029859 | A1 | 2/2018 | Hevia et al. | |
| 2018/0075375 | A1 | 3/2018 | Becker et al. | |
| 2020/0288905 | A1 | 9/2020 | Ripperda et al. | |

OTHER PUBLICATIONS

International Search Report and Written Opinion corresponding to PCT Patent Application No. PCT/US2017/050732, dated Dec. 20, 2017, 6 pages.

* cited by examiner

PROACTIVE DISPENSER TO OPERATOR MOBILE ALERT SYSTEM

REFERENCE TO RELATED APPLICATION

This application claims the benefit of U.S. provisional application No. 62/385,160, filed Sep. 8, 2016, which is herein incorporated by reference in its entirety.

BACKGROUND

Beverage and other food item dispensers that are used in restaurants, retail, and other locations for consumers to purchase beverages and food products ("consumable items") have limited capacity for storing ingredients to be mixed by the dispenser and packaged consumable items, such as cans or bottles of beverages and snacks items. Beverage dispensers are in fluid communication with ingredient containers, such as ingredient cartridges, containers, bag-in-box, etc., that are typically mixed with carbonated water. In busy stores and restaurants, when a beverage ingredient is sold out or otherwise becomes empty, customers become dissatisfied and complain to staff. The staff, in response, has to quickly respond to replace empty container(s), often during a busy period of time, such as lunch, thereby causing operations to be less efficient from a customer's perspective.

Current dispensers provide notifications of empty cartridges and ingredients through a visual display, either with a light or message on a non-customer user interface (NCUI). Such notifications are generally not beneficial as the notifications occur when the ingredients or consumable items have already become empty, and customers are typically the first to determine the sold-out status of an ingredient. Other notifications, such as an "out-of-order" notification, that indicate a problem with the dispenser are also problematic as those notifications occur when a problem occurs. Such notifications are also typically brought to the attention of an employee by a customer.

SUMMARY

To reduce or eliminate the problem of beverage ingredients being sold out on dispensers, a proactive notification system may be integrated into a dispenser. The notification system may include a sensing system inclusive of sensor(s) configured to sense levels of ingredients within cartridges or other container, where the sensor(s) may include one or more counters of the number of units dispensed. The notification system may provide for an operator to set up alert types, such as sold-out status (e.g., remaining percentage), water problems, machine malfunction (e.g., pump out), holiday notice (e.g., St. Patrick's Day), and so forth. The notification system may further be configured to distribute notifications or alerts via a communications network, such as a Wi-Fi, Internet, and/or directly to mobile devices, e.g., smart phones) of one or more operators (e.g., manager, employee). In an embodiment, an operator may define parameters for distributing the notifications to operators. Such parameters may include, but are not limited to, certain messages of certain level of employee (e.g., refills too low-level employees, pump out to a manager), notifications to employees geographically located at the store, and so on. The operator may also be able to set up phone numbers, or other network addresses of employees for the notifications of the dispenser to be delivered.

One embodiment of a consumable item dispenser and method may include an ingredient storage unit configured to store a consumable ingredient used to produce consumable items by the dispenser. A sensor may be configured to sense an amount of consumable ingredient remaining to be dispensed. An input/output unit may be configured to communicate data over a communications network. A processing unit may be in communication with the sensor, and be configured to authenticate an electronic device associated with an operator and register the electronic device associated with the operator. The processing unit may further be configured to determine whether an amount of the ingredient in the ingredient storage unit is at or below a threshold level in response to receiving a sensor signal indicative of an amount of ingredient remaining in the ingredient storage unit. In response to determining that a remaining amount of ingredient is at or below the threshold level, the processing unit may generate a notification indicative that the ingredient is at or below the threshold level. An operator may be identified to which to communicate the notification via the registered electronic device. The notification may be communicated to the registered electronic device associated with the identified operator via an input/output unit and over a communications network to notify the identified operator of the ingredient being at or below the threshold level.

BRIEF DESCRIPTION

A more complete understanding of the method and apparatus of the present invention may be obtained by reference to the following Detailed Description when taken in conjunction with the accompanying Drawings wherein.

DETAILED DESCRIPTION OF THE DRAWINGS

Figure 1A:
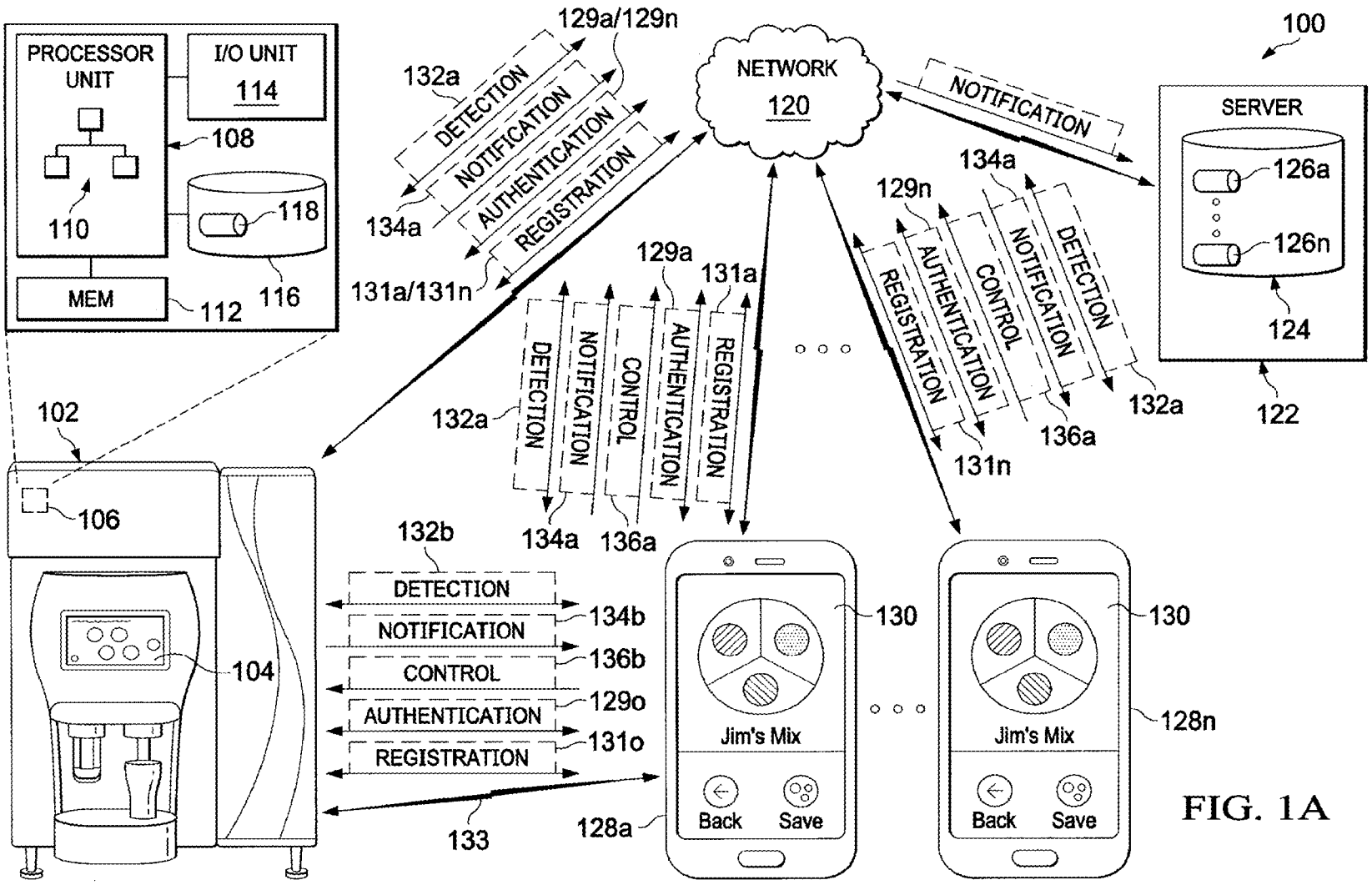
FIG. 1A is an illustration of an illustrative dispenser environment inclusive of a dispenser configured to dispense beverages selected by a user.

With regard to FIG. 1A, an illustration of an illustrative dispenser environment 100 inclusive of a dispenser 102 configured to dispense beverages selected by a user is shown. The dispenser 102 may include an electronic user interface ("UI") 104, such as a touchscreen, that enables selectable indicia to be displayed. To control the dispenser 102 and UT 104, a circuit 106 inclusive of a processing unit 108 may be utilized to execute machine readable instructions 110 to perform a variety of functions, as further described herein. The processing unit 108 may include one or more computer processors and/or discrete electronic devices. In an embodiment, the processing unit 106 may include an EEPROM, FPGA, ASIC, discrete logic, or any combination thereof for performing one or more functions, including monitoring ingredient levels in cartridges or other containers, establishing communications with operators, monitoring operations of the dispenser, and so forth.

The dispenser 102 may be configured to dispense drinks, such as soft-drinks, coffees, teas, sports drinks, alcoholic beverages, and so forth. Alternatively, the dispenser 102 may be configured to dispense foods, such as ice creams, optionally with toppings or mix-ins, snack mixes, hot foods, and so forth. Still yet, the dispenser 102 may be configured to dispense a combination of foods and beverages, such as (i) soups with noodles, rice, and/or protein (chicken, beef, shrimp), (ii) hot chocolate with marshmallows, (iii) soup and salad, (iv) milkshakes, and so on. The consumable ingredients may be stored in containers, such as cartridges, bins, jugs, bags-in-boxes, or any other container, as understood in the art.

The processing unit 108 may be in communication with a memory 112 that may be configured to store data, such as remaining levels of ingredients, operating status of the dispenser, and so on. An input/output (I/O) unit 114 may enable the dispenser 102 to communicate information externally from the dispenser 102 utilizing any wired and/or wireless communications protocol, as understood in the art. A storage unit 116 may be configured to store a data repository or database 118 that stores information of consumable ingredients (not shown) available to be dispensed by the dispenser 102.

Sensors (not shown) may be configured to monitor the ingredients in the cartridges, bins, jugs, bags-in-boxes, or other containers. In an alternative embodiment, the sensors may include optical sensors, weight sensors, counters, depth gages, electromechanical sensors, optoelectronic sensors, proximity sensors, flow sensors, or any other sensor that may provide for determining a specific or relative amount of ingredient remaining. As an example, a weight sensor may weigh a cartridge to determine an amount of fluid remaining in the cartridge. Alternatively a flow sensor may be configured to monitor how much fluid exits the cartridge. Still yet, an optical sensor may be configured to pass through a window of the cartridge to inspect when the fluid passes below a certain depth. When ingredients are dispensed in discrete units, such as when a positive displacement pump is used to pump ingredient fluids, a count can be maintained of how many times the discrete unit is dispensed from an ingredient package. The count may be based on time that the pump is pumping (e.g., on a per sub-second or per second basis). Counts for each of the ingredients may be stored in a memory associated with each ingredient and be reset automatically or manually when an ingredient is replaced at the dispenser depending on the configuration of the dispenser. The processing unit 108 executing the machine readable instructions 110 may be configured to store an absolute amount of ingredients remaining of each ingredient in the memory 112 and/or data repository 118.

As further shown, the dispenser 102 may be configured to communicate data over a communications network 120 with a server 122 operating a storage unit 124 for storing information associated with the dispenser 102 in data repositories 126*a*-126*n* (collectively 126). It should be understood that the data repositories 126 may be used to store data from multiple dispensers, such as from multiple restaurants or stores of respective chains.

The dispenser 102 may be configured to communicate with mobile devices 128*a*-128*n* (collectively 128) of operators. The operators may be managers and/or employees of a restaurant or store that may be responsible for managing the dispenser. In managing the dispenser, the operators may be responsible for changing or refilling ingredients, correcting errors of the dispenser 102, replacing filters, and so forth. As further detailed herein, the dispenser 102 may be configured to authenticate, register, store contact information, detect, and communicate with the mobile devices 128. The mobile devices 128 may execute a mobile app 130 that enables communication with the dispenser 102. The mobile app 130 may be configured to display notifications, status of ingredients, status of dispenser components, and/or other information that enables the user/operator of the dispenser 102 to manage the dispenser 102 and ingredients being used thereby. The mobile app 130 may further be configured to communicate control signals to the dispenser 102 for controlling operation or adjusting settings thereof.

TABLE I shown below includes various parameters that may be stored and managed by the processing unit 108 of the dispenser 102. The parameters may include operator name, mobile ID (e.g., phone number. IP address, or other network address that the dispenser may use to communicate with the mobile electronic devices 128). An operator level may be included to enable the dispenser 102 to optionally communicate different information, such as ingredient levels to the employees and/or managers and dispenser operational parameters to the manager. An authentication parameter may enable the dispenser 102 to authenticate the mobile devices 128, where the authentication process may be used by the users of the mobile devices 128 to initially be allowed to communicate with or receive communications from the dispenser 102.

The authentication process may include an operator logging into a dispenser management user interface (not shown) via the user interface 104 of the dispenser 102. In logging into the dispenser, the operator may enter a user name and password to enter the dispenser management user interface inclusive of a selection for establishing an authentication set-up user interface. In the authentication set-up user interface, the user may enter authentication data, such as electronic addresses (e.g., phone number), operator name, operator password, employee ID, private information (e.g., street that the operator grew up on, name of first pet, etc.), and any other authentication data desired to be used to authenticate an operator of the dispenser 102. In the operator authenticating his or her mobile devices 128, the mobile devices 128 may communicate an authentication signal 129*a* with the dispenser 102. The authentication signal may include a password, dispenser ID, and optionally an encryption key to perform the authentication, at least a first time, with the dispenser 128. Other authentication information as previously described may also be communicated with the dispenser 102.

After the authentication process, if utilized, a registration process may include communication of a registration signal 131*a*-131*n* (collectively 131) between the mobile devices 128 and the dispenser 102. A registration parameter may also be used to register the mobile devices 128 with the dispenser. The mobile app 130 may enable the operators to provide various information, including operator name and other information, during the registration process. Once registered, the mobile devices 128 of the respective operators are able to automatically communicate with the dispenser 102 when within local communication with the dispenser 102 or within geographic proximity of the dispenser 102 based on GPS, Wi-Fi, or other geo-coordinate measurement technique. In an embodiment, a near field communication tag may be positioned at the dispenser or elsewhere at the location of the dispenser for the user to tap his or her phone to establish the registration. In an alternative embodiment, a beacon technique may be used for the mobile device to identify a beacon signal to cause the mobile device to automatically communicate with the dispenser 102 or the remote server 122. In yet another embodiment, the registration may occur in response to the user entering a geofence surrounding the dispenser, which may cause the mobile device(s) 128 or server 122 to initiate a registration process.

In an embodiment, the dispenser 102 may be configured to position a "cookie" on the mobile devices 128 that are authenticated and registered to limit or otherwise remove the need for the users to have to log in each time he or she want access to communicate with the dispenser 102. A detected parameter may enable the dispenser 102 to determine whether the mobile devices 128 are available for communicating information, as further described below.

TABLE I

Operator Table

| Operator Name | Mobile ID/IP Address | Operator Level | Authenticated | Registered | Detected |
|---|---|---|---|---|---|
| Harry | 404 259-0947<br>107.128.225.39 | Manager | Y | Y | Y |
| Briana | 404 405-9669<br>110.128.135.29 | Employee | Y | Y | Y |
| Lisa | 404 966-5051<br>87.78.227.34 | Employee | Y | N | N |
| . . . | . . . | . . . | . . . | . . . | . . . |

After a user is authenticated and registered, the dispenser 102 may be configured communicate detection signals 132*a* and/or 132*b* to the mobile devices 128 via (i) a first communications channel, such as the network 120, which may be a mobile communications network, wired/Wi-Fi® network, Internet, or any combination thereof, or (ii) a second communications channel 133, which may be a Bluetooth®, Wi-Fi®, or any other local communications channel over which each of the dispenser 102 and mobile electronic devices 128 may communicate. The network addresses of the mobile devices may include telephone numbers, IP addresses, email addresses, or any other network addresses that allows for the dispenser 102 and operator via a mobile electronic device to communicate ingredient and/or operational information.

Because the functionality is meant to provide for a notification or alert system that allows for the operators to avoid having to visually inspect the dispenser 102 to determine status of ingredients, one local communications protocol that is unnecessary, although not excluded, is a near field communications (NFC) channel, which requires a mobile device to be place within a few inches of an NFC "touch point." The detection signal 132*a* and/or 132*b* may be received by the mobile device 128 and mobile app 130 operating thereon, which, in turn, may respond to the dispenser 102 to notify the dispenser 102 that one or more operators are available for responding to a notification 134*a* and/or 134*b*. The detection signal 132*a* and/or 132*b* may be communicated periodically (e.g., every 30 minutes), aperiodically (e.g., prior to communication of a notification 134*a* and/or 134*b*), or in response to a manager prompting the dispenser 102 to perform a detection, for example.

In an embodiment, detection and communication of the mobile devices 130 and dispenser 102 may occur indirectly, such as between the server 122 and the mobile device 128*a*. To initiate such a detection, a detection of the mobile device 128*a* may occur using a geofence or other signal (e.g., beacon) at a location of the dispenser 102 that causes the mobile app 130 being executed on the mobile device 128*a* to notify the server 122 of the location, which, in turn, notifies the dispenser 102 of the local proximity of the mobile device 128*a* to the dispenser 102. Thereafter, the dispenser 102 may communicate directly or indirectly with the local mobile device 128*a* until it is determined that the mobile device 128 is no longer local.

In an embodiment, in response to the user receiving a notification 134*a*, the mobile app 130 may present the notification to the user. If the notification 134*a* is in the form of an alert, such as a "pump out" alert, then the mobile app may provide the user with the ability to send a control signal 136*a*, such as a "disable" control signal, to the dispenser 102. The control signal 136*a* may be received by the processing unit 108, and the machine readable instructions 110 may cause the processing unit to issue a command to a power manager (not shown) of the dispenser 102 to shut down or may be handled by the processing unit 108 to eliminate the ability for customers to use the dispenser 102.

For example, the processing unit 108 may cause the user interface 104 to display and "OUT OF ORDER" message, and not provide or disable user interface features, thereby effectively disabling the dispenser. Control signals to instruct the dispenser 102 to perform other actions may be available, as well. For example, a change temperature control signal, change display message or graphic, or any other control signal may be available via the mobile app 130.

Figure 1B:
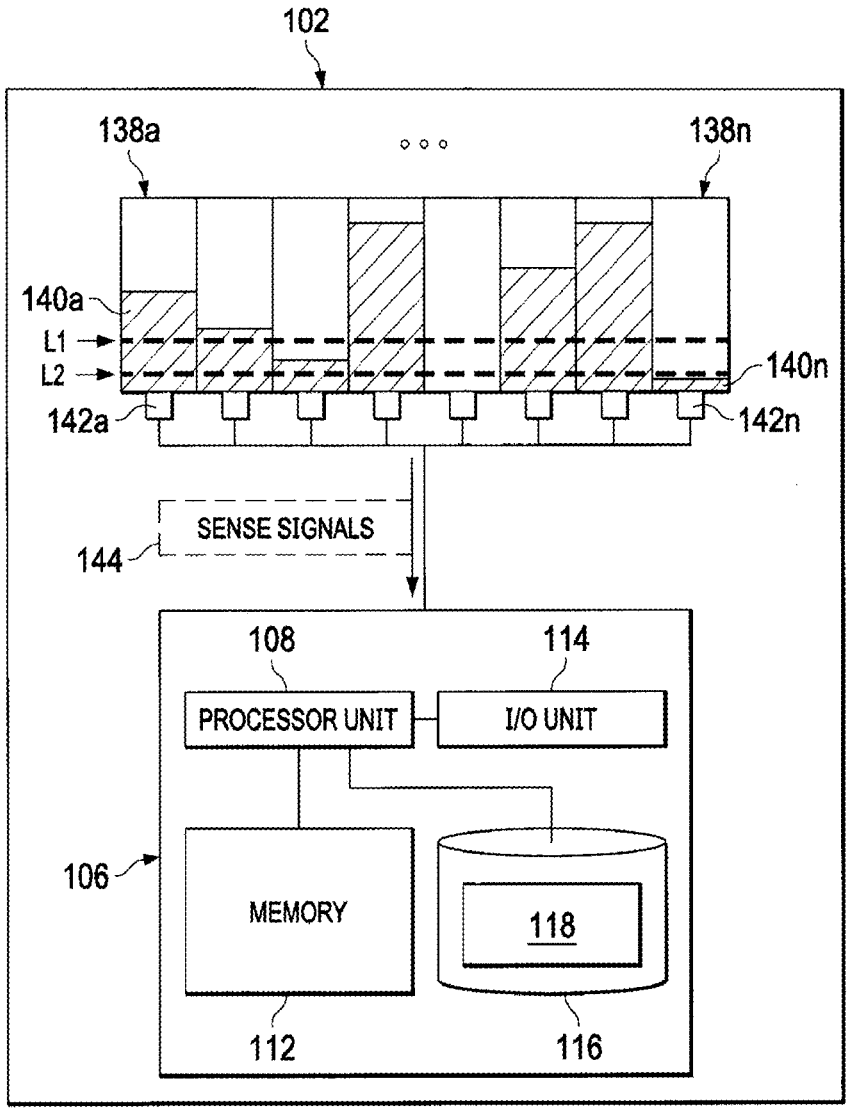
FIG. 1B is a schematic of the dispenser of FIG. 1A including ingredient storage units and sensors configured to sense levels of ingredients within the ingredient storage units.

FIG. 1B is a schematic of the dispenser 102 of FIG. 1A including ingredient storage units 138*a*-138*n* (collectively 138) in which ingredients 140*a*-140*n* (collectively 140) may be stored. While shown as being within the dispenser 102, it should be understood that some or all of the storage units 138 may be disposed outside of the dispenser 102, such as under a counter or in a back room. To sense the level of the ingredients 140 in the ingredient storage units 138, sensors 142*a*-142*n* (collectively 142) may be disposed at the ingredient storage units 138. As previously described, the sensors 142 may be weight sensors, counters, optical sensors, proximity sensors, temperature sensors, or any other sensors that may be used to determine a current level of the ingredients 140 currently in each of the ingredient storage units 138. Rather than using individual sensors for each of the ingredient storage units 138, a positive displacement pump (not shown) or other electromechanical element (e.g., valve) may be sensed using a counter or flow meter (e.g., time of applied pressure, time of being open, time of flow, etc.), and the count from the counter may be applied to (e.g., added) to current count stored in a memory location associated with the selected ingredient(s) being dispensed. The sensors 142, in sensing a level of each of the ingredients 140, may generate sense signals 144 that may be communicated to the processing unit 108 for processing thereby. At each of the ingredient storage units 138, the respective sensors 142 may be configured to measure one or more remaining balance or levels of the ingredients 140 in the ingredient storage units 138.

As shown, two levels L1 and L2 are shown to represent a height of ingredients 140 within the ingredient storage units 138 that may be sensed by the sensors 142. The two levels L1 and L2 may represent 25% and 10%, respectively. Other and/or additional levels may be monitored. Although not shown, a level of 0% or empty may be sensed using sensors 142 or in response to ingredients 140 not flowing from the ingredient storage units 138. In addition to the sensors 142 sensing that a level is crossed, the sensors may further be configured to determine a remaining amount of ingredient (e.g., percentage remaining, weight remaining, volume remaining, dispensable beverages remaining, etc.). Although not shown, sensors that are configured to sense operational parameters of the dispenser, such as electrical power sensor to determine pump operation, thermostat to sense temperature of ingredients, water being used for dispensing, or temperature of a cooler in which ice is being stored, power sensor to sense lighting, electronic display operation, or otherwise.

Figure 2:
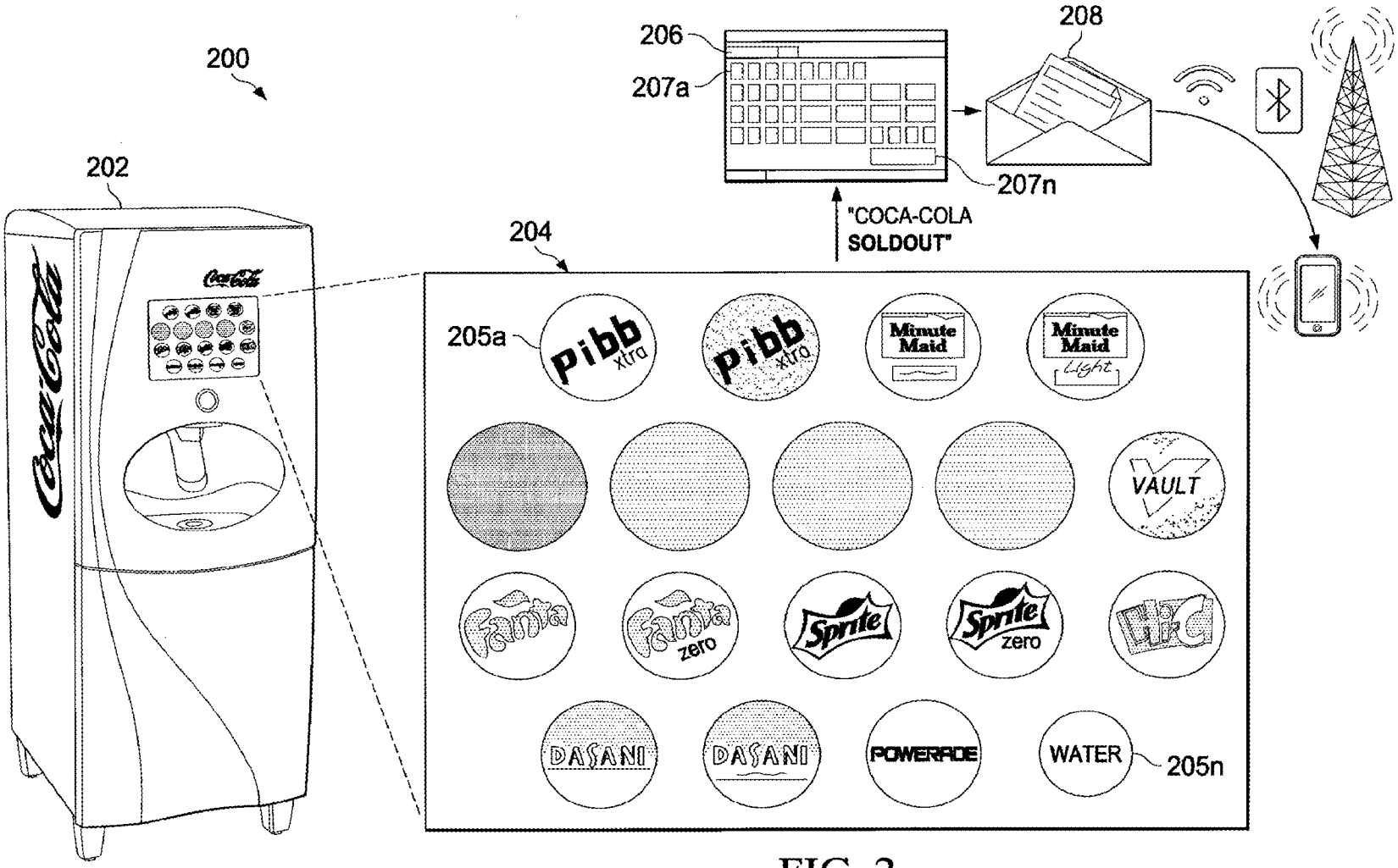
FIG. 2 is an illustration of an illustrative dispenser environment shown to include a dispenser inclusive of a user interface.

With regard to FIG. 2, an illustration of an illustrative dispenser environment 200 is shown to include a dispenser 202 inclusive of a user interface 204. The user interface 204 is shown to include multiple indicia 205*a*-205*n* (collectively 205) indicative of available beverages that may be dispensed by the dispenser 202 in response to a user selecting one or more of the indicia 205. A listing 206, which is shown graphically, may be stored in a data repository of the dispenser 202, and may include data fields 207*a*-207*n* (collectively 207) associated with each of the beverages identified in the indicia 205. The data fields 207 may include data indicative of percentage of ingredient remaining in an ingredient cartridge, for example, and the data may be defined as a relative amount, volume, and/or otherwise, and the data may be defined as a percentage, volume, and/or otherwise.

The dispenser 202 may be configured to communicate the data of the data fields 207 in one or more data messages 208 using any communications protocol, including cellular, Wi-Fi, Bluetooth, or otherwise. The data messages 208 may be communicated to a mobile device 210 executing a mobile app that may display the data for a user. In an embodiment, in the event that the data is indicative of an ingredient running low, the mobile app may highlight or otherwise create a notification (e.g., display the data or a data cell in a particular color, such as the color red) for the user to recognize that an ingredient is getting low and needs to be replaced. In an alternative embodiment, rather than communicating all of the data in the data fields 207 to the mobile device 210, the dispenser 202 may be configured to communicate only data below a threshold level, such as 20% remaining in a cartridge of the respective ingredient.

Figure 3A:
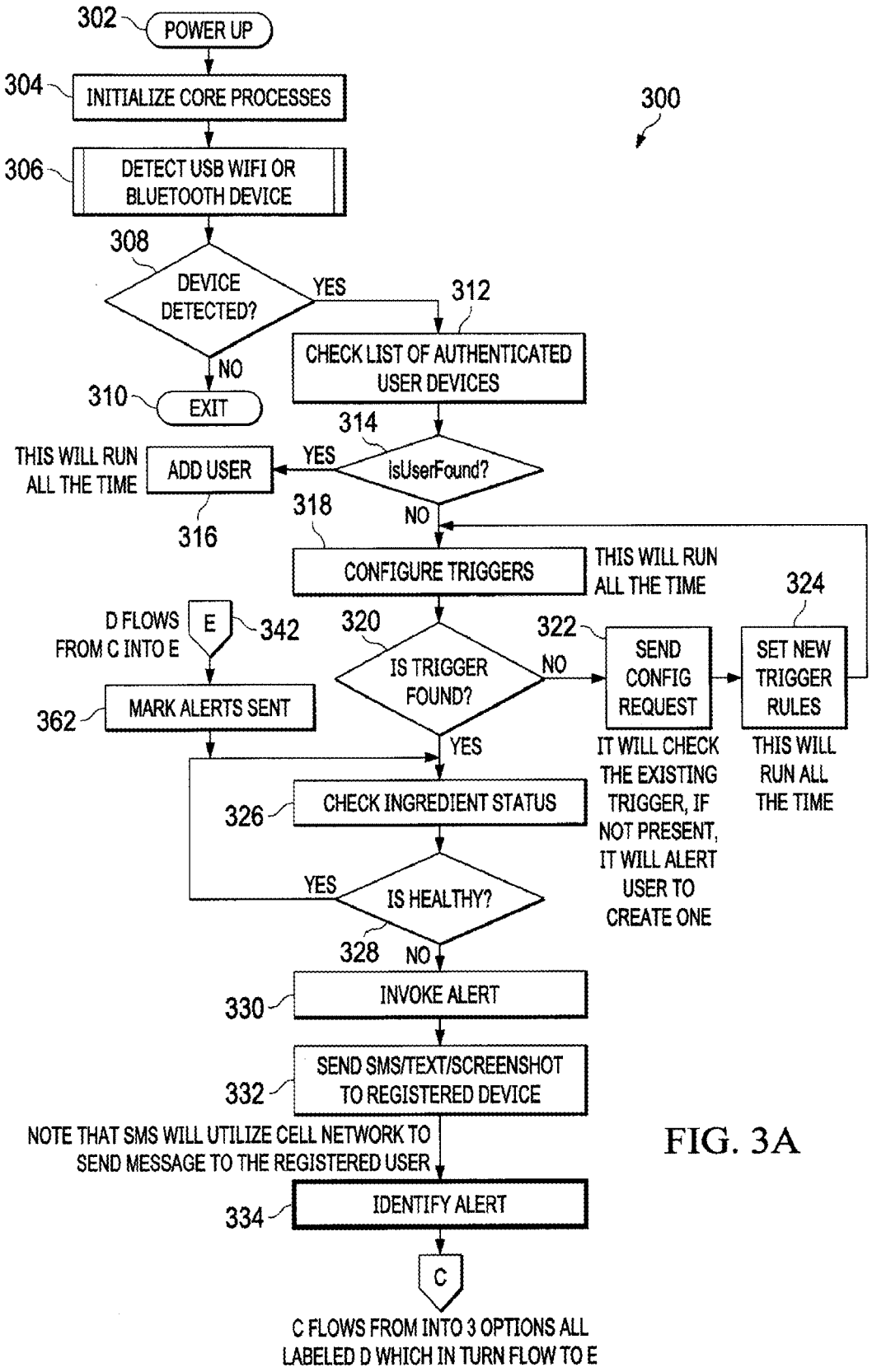
FIGS. 3A-3D are flow diagrams of an illustrative operational process of a dispenser.

With regard to FIG. 3A, a flow diagram of an illustrative operational process 300 of a dispenser is shown. The process 300 may start at step 302, where the dispenser may be powered up. At step 304, core processes may be initialized. The core processes may include checking status of the ingredients, checking temperature of water, and so on. Additionally, the core processes may include verifying any operational functionality of the dispenser, such as pump operation, valve operation, communication electronics that communicate externally from the dispenser, processing system operation, sensors operation, and so on. At step 306, a detection of any device having a USB, Wi-Fi, Bluetooth, or other communications connection.

At step 308, a determination may be made as to whether any devices are detected. If no devices are detected, the process 300 may continue at step 310, where the process exits. If a device may be detected at step 308, then the process may continue at step 312, where a device that is detected is compared against an authenticated user device list being stored by the dispenser. At step 314, a determination may be made as to whether a user associated with a detected device is found. If not, then the process 300 may continue at step 316, where the user is added. In adding the user, information may be collected from the user, such as the user's name, job position, or any other information that may be used by the dispenser for communicating data thereto.

If a determination is made at step 314 that the user is found, then the process may continue at step 318, where triggers may be configured. In configuring the triggers, a list of available triggers may be displayed for an operator to select. The triggers may include a variety of parameters that the dispenser may use to determine when to send out a notification or alert to a user, such as one or more level thresholds of the ingredients. If a determination is made at step 320 that a trigger is not found, then the process 300 may continue at step 322, where a configuration request may be sent to a user to create the trigger. At step 324, the user or operator may set one or more trigger rules associated with a parameter for the process to communicate a notification or alert to a user. The trigger rules may include sending on a periodic basis (e.g., hourly or more often during meal times) or event basis (e.g., responsive to a threshold be crossed). In an embodiment, the trigger rules may cause a status check of the ingredients after each dispense operation. The trigger rules may also include limiting communications or alerts only to devices that are determined to be local to the dispenser, only to devices associated with operators during their respective work shifts, only to managers, only to employees assigned to replace or refill ingredients, and so forth. The process 300 returns back to step 318 to enable the operator to configure any other triggers he or she desires. If, at step 320, a determination is made that the trigger is found, then the process continues at step 326, where an ingredient status or condition is checked based on the trigger condition.

The process continues at step 328, where a determination may be made as to whether the ingredient is "healthy" or does not meet a trigger condition. If it is determined that the ingredient does not satisfy the trigger condition (e.g., a remaining volume of an ingredient exceeds a 20% threshold), then the process may return to step 326 to continue checking the status of the ingredient. However, if it is determined that the ingredient status meets the trigger condition, then at step 330, an alert may be invoked. The alert being invoked may cause a message to be communicated to a registered device at step 332. The message may include an SMS message, text message, application notification, screenshot image, or any other message that may be communicated via a communications channel using an appropriate communications protocol. The communications protocol may be through a mobile communications network, Wi-Fi network, Bluetooth communications link, or otherwise. The process may continue at step 334, where the alert may be identified. In identifying the alert, three operations may be performed, as provided in steps 336*a* in FIG. 3B, 336*b* in FIG. 3C, and 336*c* in FIG. 3D.

Figure 3B:
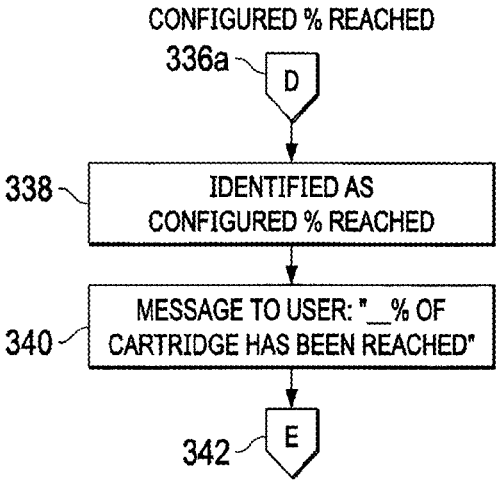

With regard to FIG. 3B, the process 300 may continue at step 336*a*, and at step 338, a determination may be made that the ingredient has reached a certain configured percentage. A message may be communicated to the user that a percentage of cartridge has been reached at step 340. The remaining percentage may be by weight, by volume, by remaining number of services, or otherwise. The process 300 may continue at step 342.

Figure 3C:
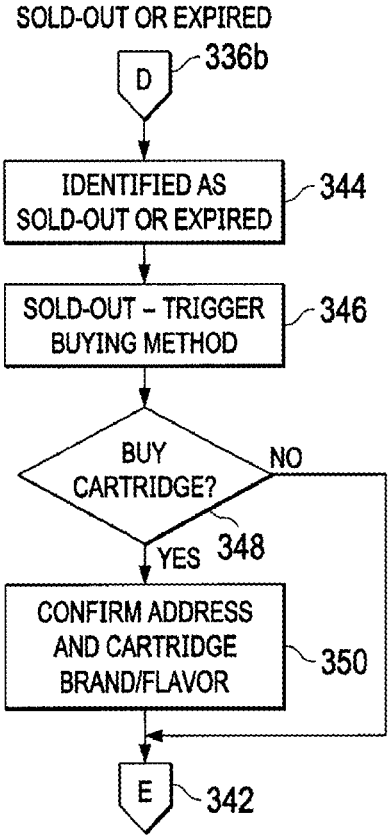

With regard to FIG. 3C, the process 300 may continue at step 336*b*, and at step 344, a determination that the ingredient is identified as being sold-out or expired may be made. At step 346, the process 300 may initiate a buying process if a trigger for buying or ordering the ingredient in response to being sold-out is set up to initiate such a purchase. If, at step 348, a decision is made not to buy the cartridge, then the process continues at step 342. Alternatively, if a determination is made that the dispenser is to initiate a buying or purchasing of a new cartridge, then the process continues at step 350, where an address confirmation and cartridge brands/flavor may be ordered or initiated to be ordered. The process thereafter continues at step 342.

Figure 3D:
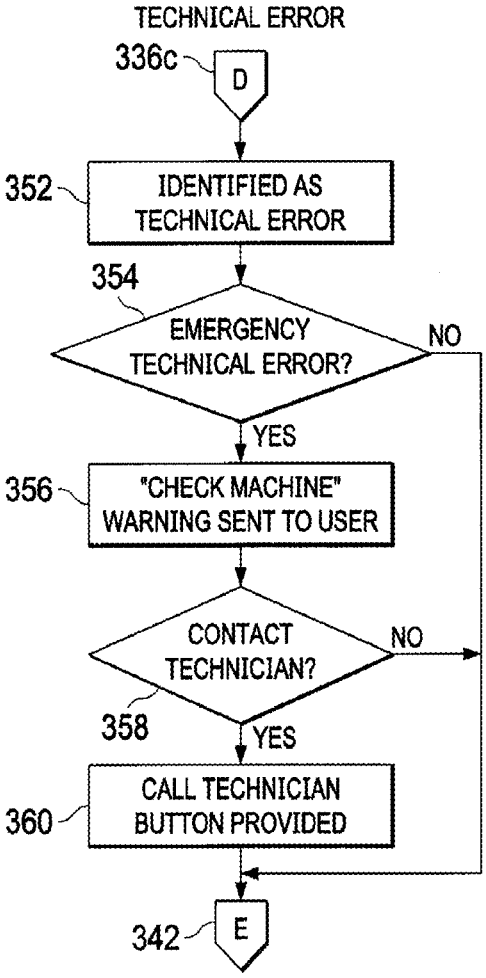

With regard to FIG. 3D, the process 300 may continue at step 336*c*, and at step 352, a technical error may be identified. The technical error may include a wide variety of technical errors at the dispenser, such as water being unavailable, cartridge being misaligned, pump being out, or any other operation of the dispenser that may be sensed to not be working properly. At step 354, a determination may be made as to whether the technical error qualifies as an emergency. If not, then the process continues at step 342. Otherwise, if the technical error is determined to qualify as an emergency, the process 300 may continue at step 356, where a "check machines" warning may be sent to an operator. At step 358, a determination may be made as to whether or not to contact a technician. If not, then the process 300 continues at step 342. If a determination is made to contact a technician, optionally based on feedback provided by a user, the process continues at step 360, where a call technician button may be provided to the user via a mobile app or otherwise (e.g., link in a text message). The process 300 may continue at step 342. At step 362 in FIG. 3A, any alert or notifications that were sent out to a user or operator may be marked or otherwise stored in a data repository. The process 300 may return at step 326.

The below pseudo code provides for an illustrative machine-like description of at least a portion of the process 300.

TABLE II

Pseudo Code 1 of 3
Pseudo code:

```
Function Power( )
{
InitializeSystem( );
startCoreProcesses( );
int devId = detectConnection( );
    if(devId Not Zero)
    {
        remoteAlertStart(devId);
    }
    Else( )
    {
        remoteAlertEnd( );
    }
//Continue normal operation with other processes. DRAM will not be invoked again until next
//reboot.
}
Int detectConnection( )
{
    Int Devcode;
    If(isUSBDevicePresent( ) == true)
    {
        Devcode = usbDev;
}
```

TABLE III

Pseudo Code 2 of 3

```
Elseif (isBluethoothDevicePresent( ) == true)
{
    Devcode = blueToothDev;
```

TABLE III-continued

Pseudo Code 2 of 3

```
        }
        Elseif(isNFCDevicePresent( ) == true)
        {
            DevCode = nfcDev;
        }
        Else
        {
            devCode = O;
        }
        Return devCode;
    }
    Void remoteAlertStart(int devId)
    {
    //This will be an independent thread to monitor status
        If(checkAutheticationList( ) == true)
        {
        If(userFound == false)
        {
            addNewUser( ); //register user who wants to get the alerts
        }
        Else
```

TABLE IV

Pseudo Code 3 of 3

```
        {
                While(checkTriggerCondition( ) == false);
        }
        while(true)
        {
                checkIngredientStatus( );
                if(ingredient unhealthy)
                {
                    invokeAlertMessage( );
                }
            }
        } //while( )
        } //checkAuthenticationList( )
    }//remoteAlertStart( )
    Void remoteAlertEnd( )
    {
        Perform process cleanup;
        Exit DRAM process;
    }
```

Figure 4:
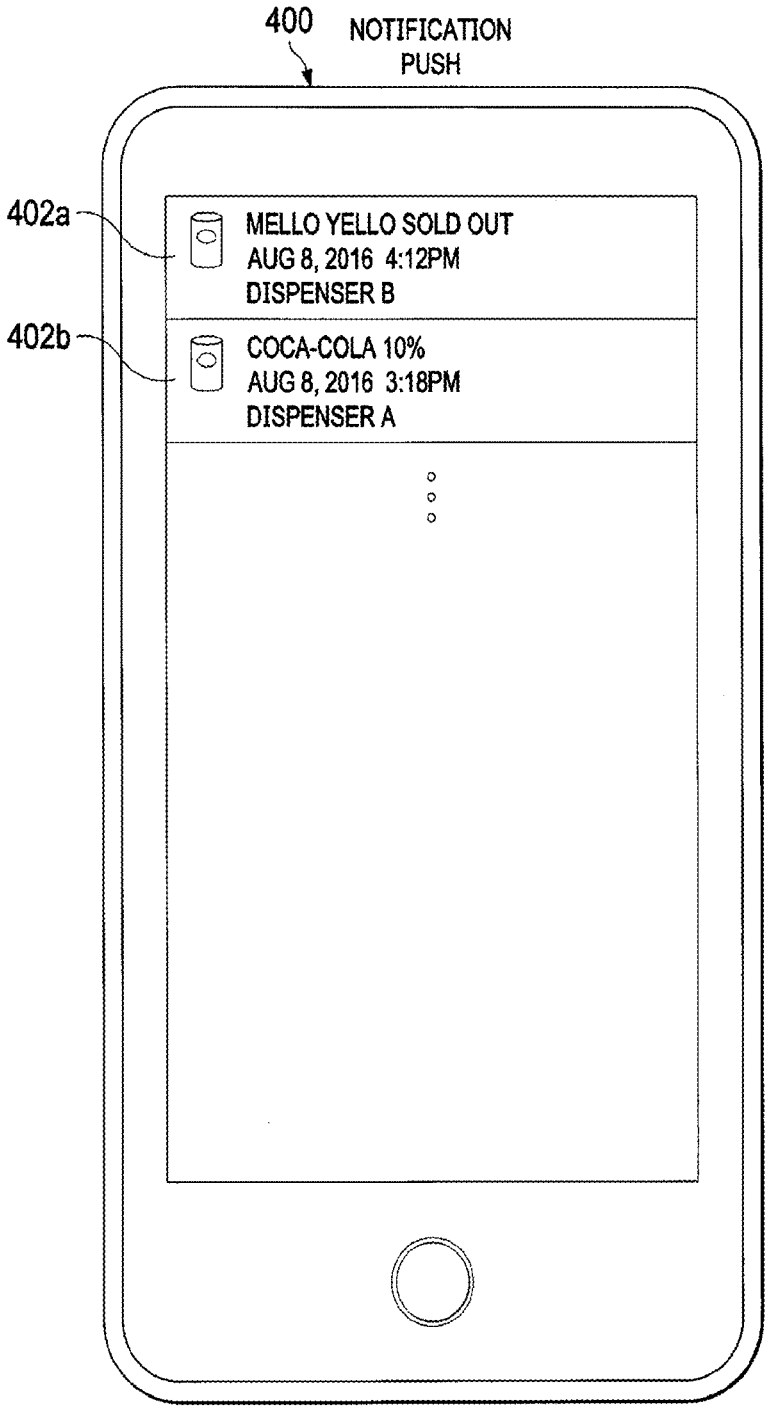
FIG. 4 is an illustration of an illustrative mobile electronic device that is shown to include a message in response to a dispenser sensing and determining that an ingredient is low or sold out.

With regard to FIG. 4, an illustration of an illustrative mobile electronic device 400 is shown to include notification messages 402*a* and 402*b* (collectively 402) in response to a dispenser, in this case a beverage dispenser, sensing and determining that an ingredient, in this case Mellow Yellow®, is low or sold out. A first notification message 402*a* may be presented in a headline or list format and include a name of the ingredient, timestamp, dispenser ID if multiple dispensers are located at a site or if an operator is responsible for dispensers on multiple sites. In response to a user selecting the message 402, a more detailed listing (not shown) of the notification may be shown. The more detailed listing may include additional information, such as history of changing or refilling a cartridge with the ingredient, last operator to change the cartridge, estimated number of beverages to be poured based on history of the use of that ingredient during comparable time periods, and so forth. A second notification message 402*b* is shown to include a brand name, remaining amount in a cartridge or other storage item, timestamp, and dispenser ID. It should be understood that additional and/or alternatives information may be provided in the notification messages 402.

In an embodiment, the notification messages 402 are push notification messages, such that the dispenser(s) push notification messages via a mobile app to the operator(s). In an alternative embodiment, the notification messages 402 are pull notifications, such that the mobile apps, operating on the mobile device 400 may send a query to one or more dispensers with which the mobile device 400 is registered to request messages. The mobile app may be configured to send queries on a periodic (e.g., every 10 minutes) or aperiodic (e.g., each time the app is opened) basis. In an embodiment, a request soft-button (not shown) may enable the user to send a query to each of the dispensers with which the mobile device 400 is in communication, thereby causing the dispensers to send the notification messages 402 to the mobile device.

The mobile app may provide for a variety of settings relative to the messages, including setting a duration of the messages to be displayed, snoozing messages, preventing deletion of the messages until an action is taken, a completion of replacement of the ingredient or cartridge containing the ingredient, correction of a dispenser failure, and so on. The mobile app (or other software program operational on a computing device) may provide for setting trigger conditions (e.g., percentages, expired, low, full, technical service required, etc.) for the mobile app to provide notice to the operator or that creates functional settings on the dispenser itself. The mobile app may further be configured to convert a remaining amount of ingredient into a number of beverages capable of being dispensed with that remaining amount of ingredient. Still yet, an approximate amount of time based on historical usage of the dispenser during a time period may be provided by the mobile app (or dispenser communication to the mobile app).

Figure 5:
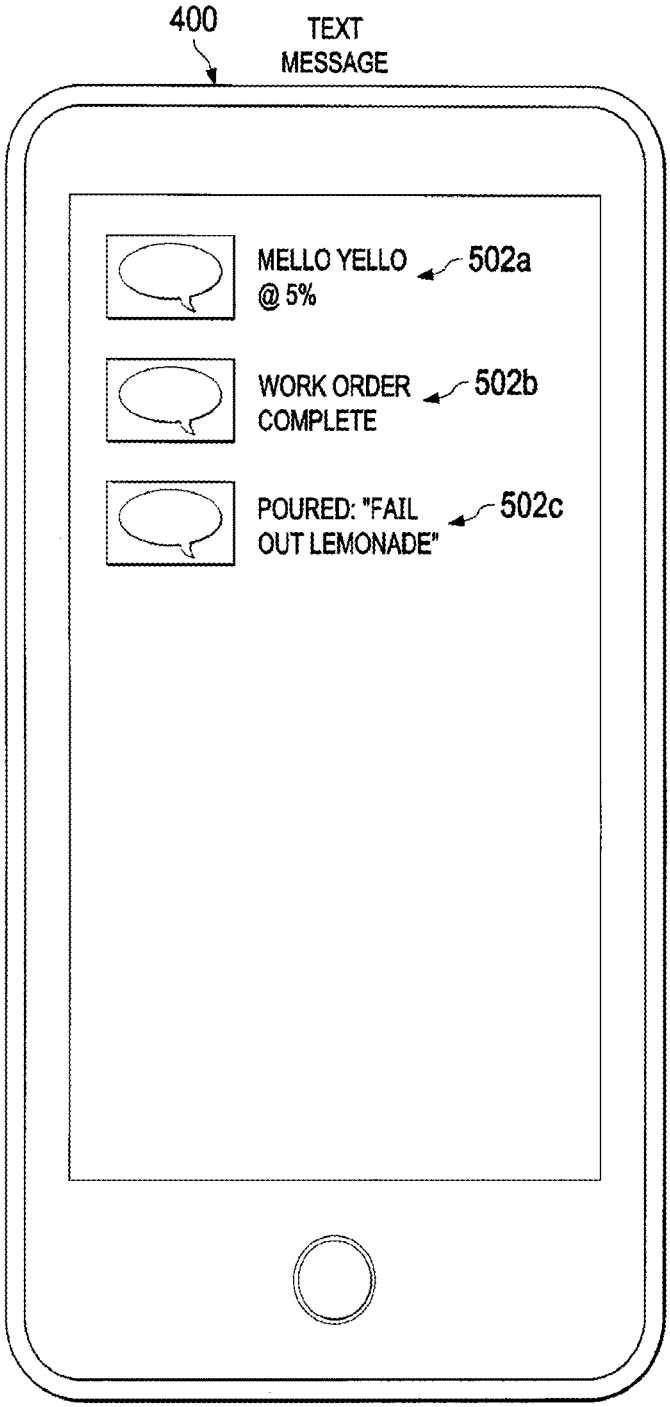
FIG. 5 is an illustration of the illustrative mobile electronic device of FIG. 4 may include a number of SMS or text messages.

With regard to FIG. 5, an illustration of the illustrative mobile electronic device 400 of FIG. 4 is shown to include a number of SMS or text messages 502*a*-502*c* (collectively 502). The text messages 502, as understood in the art, may have up to 140 characters, and may include a link (not shown) that enables the operator to select to view a more complete message or a list of messages available to the operator. The text messages 502 may be sent to the mobile device 400 of the operator in response to the operator selecting to have messages communicated via text message, as further described herein.

Figure 6:
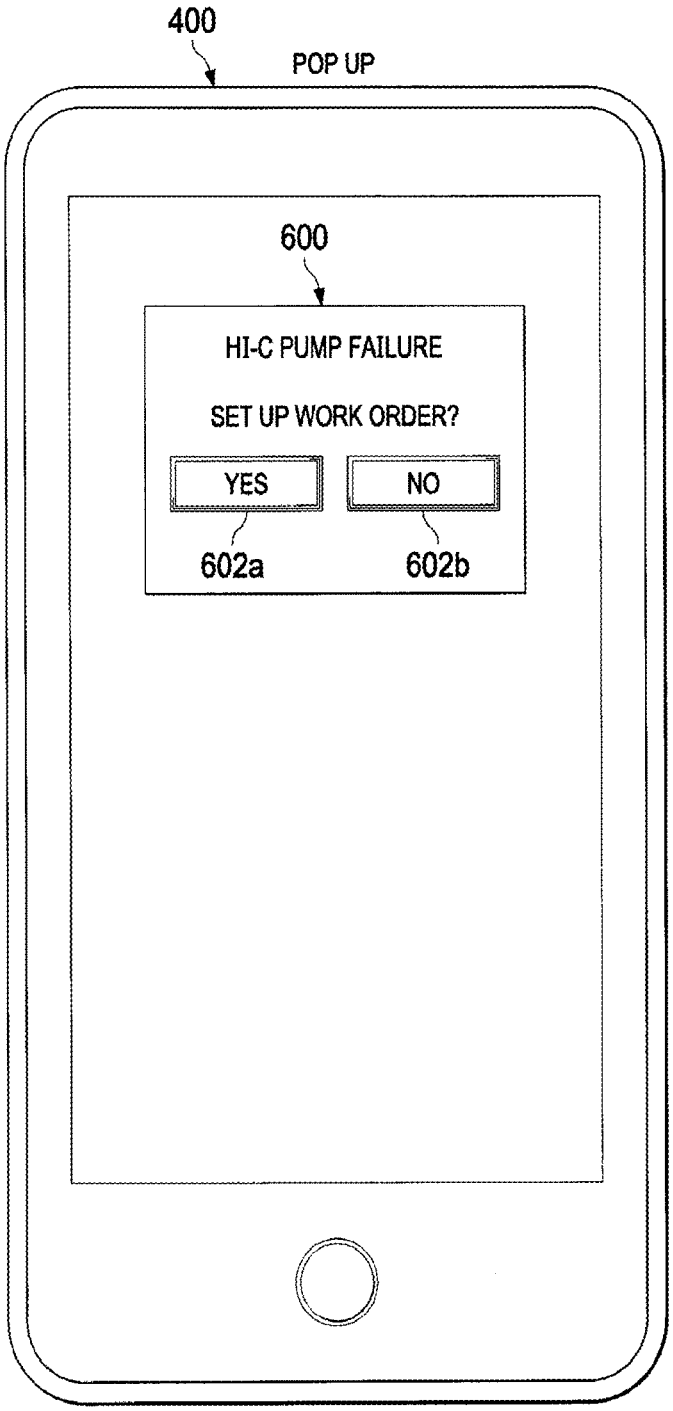
FIG. 6 is an illustration of the illustrative mobile electronic device of FIG. 4 that may include a pop-up message window to indicate that a failure at the dispenser has occurred.

With regard to FIG. 6, an illustration of the illustrative mobile electronic device 400 of FIG. 4 is shown to include a pop-up message window 600 to indicate that a failure at the dispenser has occurred. As shown, the message failure may indicate that a "Hi-C® pump failure" has occurred, and a request as to whether a work order is to be set up or otherwise scheduled. A "yes" soft-button 602*a* and "no" soft-button 602*b* may be displayed for users to respond to the work order request. In response to the user selecting the "yes" soft-button 602*a*, a work order may automatically be scheduled, and a message may be sent to a technician.

Figure 7:
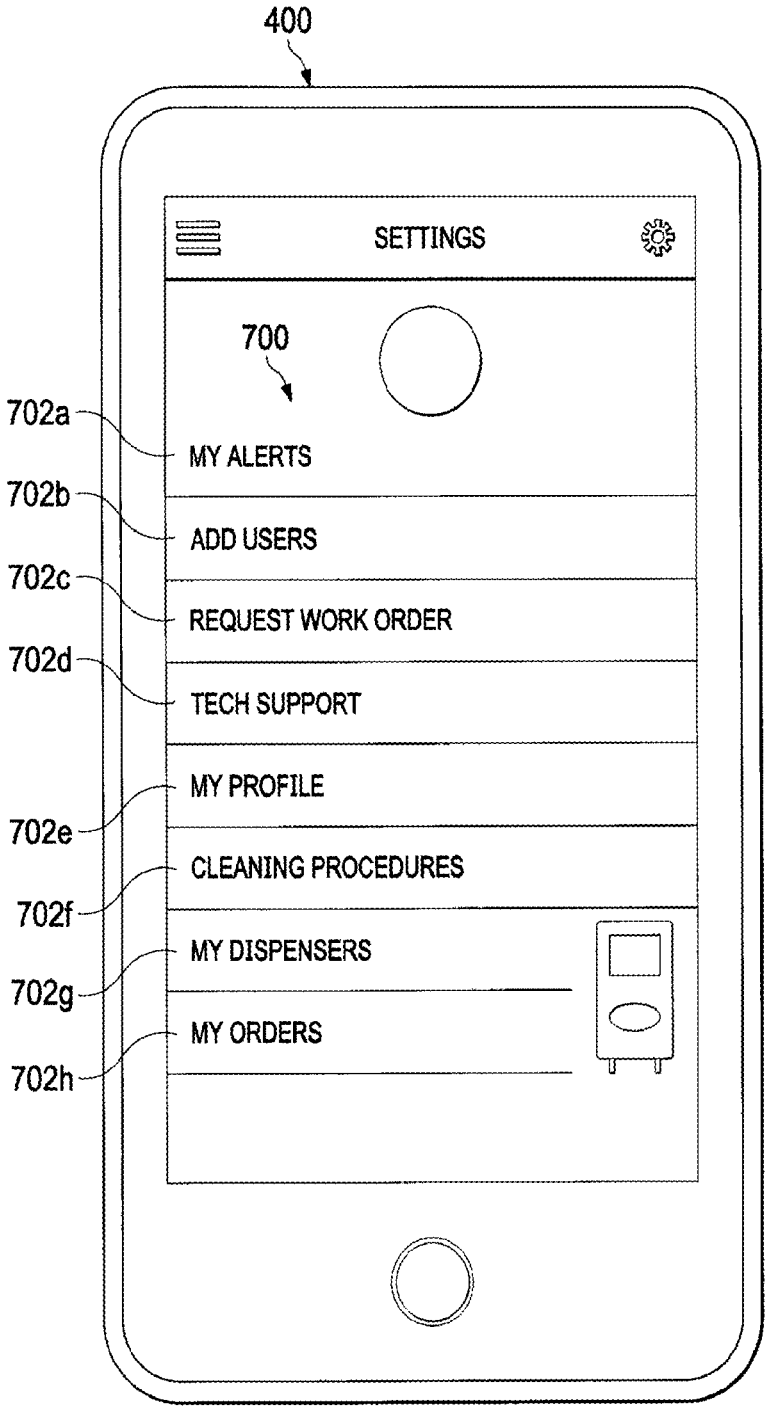
FIG. 7 is an illustration of the illustrative mobile electronic device of FIG. 4 that may include a settings user interface inclusive of a number of selectable options.

With regard to FIG. 7, an illustration of the illustrative mobile electronic device 400 of FIG. 4 is shown to include a settings user interface inclusive of a number of selectable options 700. The selectable options 700 may include a "My Alerts" soft-button 702*a*, "Add Users" soft-button 702*b*, "Request Work Order" soft-button 702*c*, "Tech Support" soft-button 702*d*, "My Profile" soft-button 702*e*, "Cleaning Procedures" soft-button 702*f*, "My Dispensers" soft-button 702*g*, and "My Orders" soft-button 702*h* (collectively 702), as further described herein. Responsive to the user selecting one of the soft-buttons 702, a user interface inclusive of settings and/or information associated with the option may be presented on the mobile app or browser in the event that the mobile app is web-based.

The "My Alerts" soft-button 702*a* may be used to display a user interface that allows the user to set desired alerts to receive and/or view alerts that are received from a dispenser. The "Add Users" soft-button 702*b* may be used to display a user interface that allows a user to add users to be able to receive notifications from the dispenser. In an embodiment, the user may be able to establish a new user to be authenticated. In establishing the new user for authentication, a serial number, password, and/or other authentication information may be established with the dispenser for authentication by the new user via his or her mobile device. The "Request Work Order" soft-button 702*c* may be used to enable the user to view a user interface that provides for requesting a work order via a technician, employee, or otherwise. The work orders may range from refill an ingredient to replace pump. The "Tech Support" soft-button 702*d* may be used to display a user interface that enables the user to communicate with technical support via a chat, email, video chat, telephone call, and so forth using graphical user elements on the user interface. The "My Profile" soft-button 702*e* may be used to display a profile of the user, including name, mobile identifier, dispenser(s) with which the user is authenticated, registered, and currently in communication, optionally after being detected by a dispenser. The "Cleaning Procedures" soft-button 702*f* may be selected to display cleaning procedures for one or more dispensers, thereby allowing the operator to clean the one or more dispensers. The "My Dispensers" soft-button 702*g* may be selected to display a user interface that shows which dispensers the operator is configured to receive notifications. The "My Orders" soft-button 702*h* may be selected to display a user interface that lists orders that the operator has placed. The orders may include orders for new ingredients for refills. The orders may be for cartridges or other ingredient storage units in which ingredients may be enclosed for inclusion in the dispenser. Certain user interfaces available to be view from selection of the soft-buttons 702 are shown hereinafter.

Figure 8:
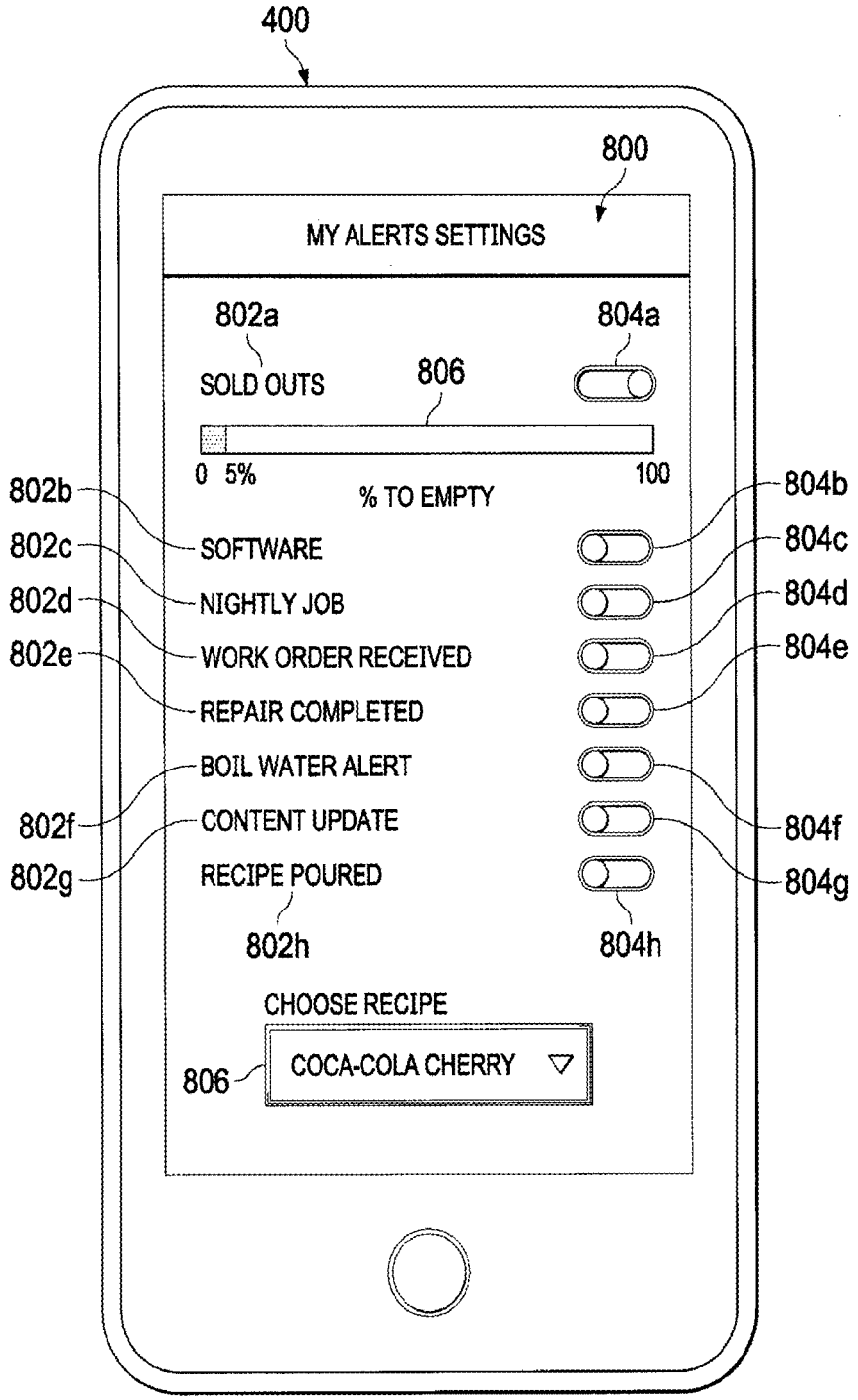
FIG. 8 is an illustration of the illustrative mobile electronic device that includes a "My Alerts Settings" user interface.

With regard to FIG. 8, an illustration of the illustrative mobile electronic device 400 of FIG. 4 that includes a "My Alerts Settings" user interface 800 is shown. The user interface 800 may include a number of different selectable options, including a "sold outs" option 802*a* that enables an operator to turn on or turn off receiving an alert using a toggle user interface element 804*a*. In an embodiment, the "sold out" option 802*a* may further include a scale 806 that enables the user to set a percentage ranging from 0% to some percentage below 100%, but typically 0% to 25%, at which a dispenser is to send an alert to the operator with sufficient enough time to enable the operator to replace or refill a cartridge or other dispenser mechanism with an ingredient. Although only a single scale 806 is shown, it should be understood that multiple scales or other graphical user interface elements may be shown to provide additional levels of notifications to the operator. For example, there may be two or three different scales that allow the operator to set different levels at which the dispenser is to notify the operator (e.g., 20%, 10%, 5%, and empty). A time stamp may be included with each notification. Additionally, toggle user interface elements may be available in association with each of the scales to turn on and turn off the notifications with respect to each of the scales. The different scales may be configured to be operative during different times of the day (e.g., higher percentages during meal times) or, if the dispenser is in communication with a point-of-sale (POS), during times that the POS is registering a certain number of sales per minute, for example.

A "Software" option 802*b* may enable a notification to be sent to the operator in response to software at the dispenser being updated. The option 802*b* may also enable for a notification to be sent in response to a software malfunction occurring. Notice of either option may be sent to the operator by a toggle user interface element 804*b* being set to an ON position.

A "Nightly Job" option 802*c* may be used to notify the operator of any work being performed on the dispenser at night. To initiate the notification, the operator may activate a toggle user interface element 804*c*. The option 802*cc* may also enable other notifications to be sent to the operator off-hours (e.g., nightly).

A "Work Order Received" notification option 802*d* may be set to notify the operator of any work orders that were submitted for the operator to perform. The operator may set a toggle user interface element 804*d* to turn on notifications for work orders to be performed on the dispenser. The work orders may include a variety of actions, including servicing the machine hardware, servicing the machine software, and/or managing replacements and refills of ingredients. The notifications may be notifications automatically generated by the machine, such as an error notification being generated in response to a sensor sensing an error of a component or function of the dispenser that requires servicing. Additionally, the notifications may be semi-automatically generated, such as by the dispenser showing an error and a user selecting a soft-button to initiate a work order. Still yet, a work order request may be generated by an operator via the dispenser, mobile app, or other interface (e.g., web-based app) for the dispenser to be serviced.

A "Repair Completed" notification option 802*e* may be established to have each repair, optionally including refilling ingredients, such as replacing a cartridge with an ingredient. To turn on the notification option 802*e*, the operator may set a toggle user interface element 804*e* to turn on the notifications for repair completions. In operation, a repair completion notification may be initiated by an operator or technician repairing the dispenser or refilling an ingredient. The dispenser may either automatically sense the repaired or refilled ingredient or enable the operator interacting with a user interface on the dispenser to manually indicate that the dispenser was repaired and/or ingredient refilled. In response, the dispenser may store information that indicates the repair being completed, and communicate the information to one or more operators via mobile devices on a mobile app or otherwise.

A "Boil Water Alert" notification option 802*f* may be used to notify an operator that a boil water advisory has been issued in the area of the dispenser from a municipal water supply, by setting a toggle user interface element 804*f*. To turn on the notification option 804*f*, the operator may set a toggle user interface element 804*f* to turn on the notifications to cause the operator to be notified so as to determine whether or not to shut down the dispenser.

A "Content Update" notification option 802*g* may be used to notify an operator of updates to content at the dispenser. The content update may include updates to images, information associated with ingredients, and so on. The notifications may help an operator ensure that content is properly updated by an information technology technician of which a manager operator expects to occur.

A "Recipe Poured" notification option 802*h* may be used to notify an operator of a recipe to be poured. The notification may notify the operator that the dispenser is pouring a particular recipe, such a pouring amounts over time. In this case, the notification may be a tracking notification over time, as opposed to an alert-type of notification. Of course, an alert notification may be performed, as well. A user interface element 806 may be used to enable the operator to select a particular recipe to monitor. The recipe may be stored in a data repository of the dispenser.

Figure 9:
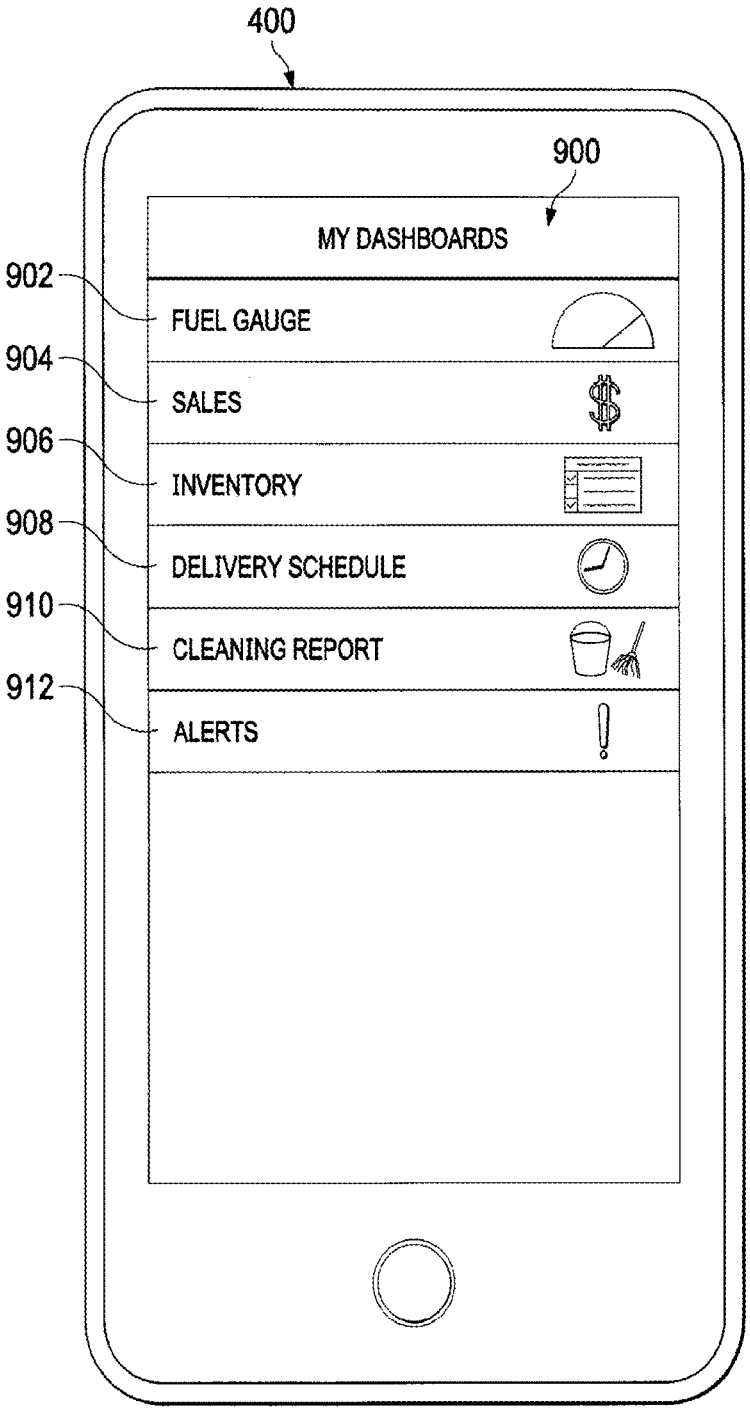
FIG. 9 is an illustration of the illustrative mobile electronic device that includes an illustrative "My Dashboards" user interface.

With regard to FIG. 9, an illustration of the illustrative mobile electronic device that includes an illustrative "My Dashboards" user interface 900 is shown. The user interface 900 is shown to include access to a number of dashboard user interfaces by selecting a "Fuel Gauge" soft-button 902, "Sales" soft-button 904, "Inventory" soft-button 906, "Delivery Schedule" soft-button 908, "Cleaning Report" soft-button 910, and "Alerts" soft-button 912. The soft-buttons and available dashboard user interfaces are illustrative, and it should be understood that any number of additional and/or alternative dashboard user interfaces may be available for selection and viewing.

Figure 10:
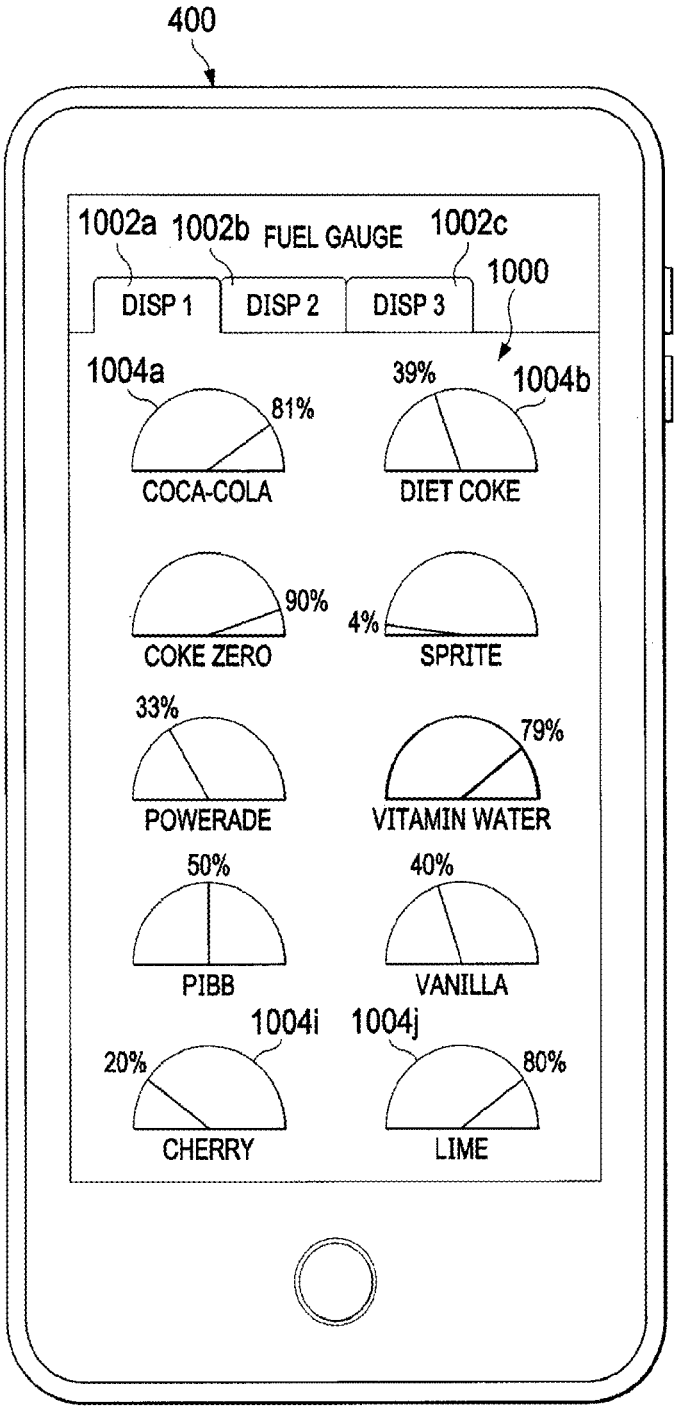
FIG. 10 is a screenshot of an illustrative fuel gauge user interface to monitor ingredients.

With regard to FIG. 10, a screenshot of an illustrative fuel gauge user interface 1000 to enable an operator to monitor ingredients being dispensed by a dispenser is shown. The user interface 1000 may include multiple tabs 1002*a*-1002*c* (collectively 1002) that enable a user to view additional fuel gauges. The user interface 1000 is shown to include a first set of fuel gauges 1004*a*-1004*j* (collectively 1004) indicative of current levels of ingredients to produce respective brands and flavors of the brands. As shown, the brands are of beverages, including Coca-Cola®, Diet Coke®, Coke Zero®, Sprite®, Powerade®, Vitamin Water®, Pibb®, Coca-Cola Vanilla®, Coca-Cola Cherry®, and Coca-Cola Lime®. Depending on the brand, one of more flavors of the brand may be available to monitor as a fuel gauge. It should be understood that alternative indicia for monitoring a level amount of the ingredients may be provided. As an example, a thermometer gauge may be utilized. In the user interface 1000, ten fuel gauges are shown. Alternative numbers and sizes of fuel gauges 1004 may be utilized. The fuel gauges are representative of percentage, but other measures or metrics may be utilized, such as number of beverages (optionally defined by small, medium, large, or average based on historical measures) available to be dispensed, estimated amount of time based on historical data on a given day and time, or otherwise. The operator may select the second and third tabs 1002*b* and 1002*c* to view additional fuel gauges or other information associated with remaining amounts of ingredients to be dispensed by the dispenser.

Figure 11:
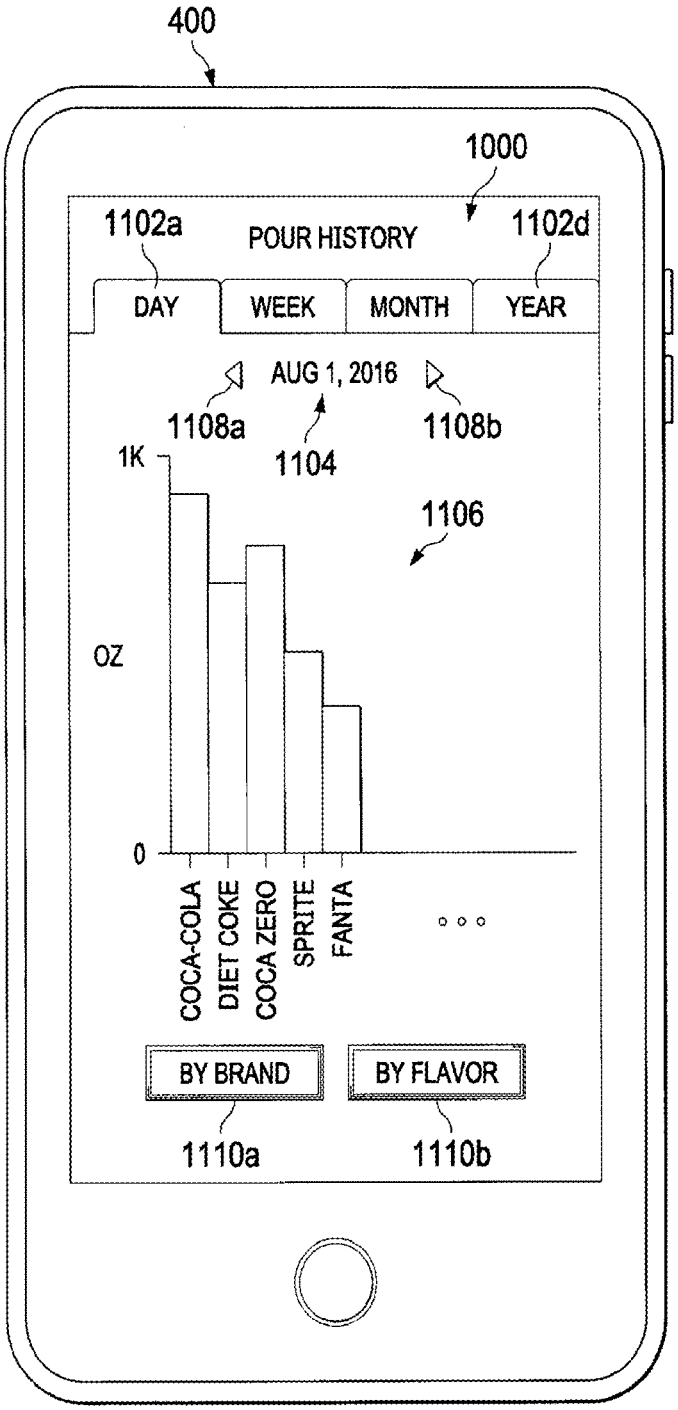
FIG. 11 is an illustration of the illustrative mobile electronic device on which an illustrative user interface displays pour history or consumption history.

With regard to FIG. 11, an illustration of the illustrative mobile electronic device 400 of FIG. 4 on which an illustrative user interface 1100 displays pour history or consumption history is shown. The user interface 1100 is shown to include multiple tabs 1102*a*-1102*d* associated with different time periods, including day, week, month, and year. Alternative time periods, including user-defined, may additionally or alternatively be provided. Rather than using timing, alternative metrics may be used, including geography, stores, rankings, and so forth that may be useful for a user to view when reviewing pour or ingredient dispense history. A date 1104 may show a date or date range, depending on which tab is selected, over which pour history data 1106 being displayed is shown.

The data 1106 may be displayed in a graph, such as a bar graph as shown, table, pie chart, or any other alphanumeric or graphical representation, and include any of the ingredients that the user may select in the user interface element 806 of FIG. 8. The system may automatically identify the ingredients by identifying an ingredient cartridge or identifier on or associated with the ingredient cartridge. As an example, ingredient cartridges may include RFID tags, barcodes or other machine readable indicia that may be scanned by a mobile device of an operator or dispenser, if configured with a barcode scanner, to indicate that the cartridge is replaced. The replacement may provide for a verification that a sensor (e.g., flow, volume, weight, or other sensor) on the dispenser is operating properly. The user may utilize graphical user interface elements 1108*a* and 1108*b* to change the date of the data to view. In an embodiment, "By Brand" soft-button 1110*a* and "By Flavor" soft-button 1110*b* may be provided for the operator to view data 1106 by brand or by flavor, and the data 1106 may be filtered by either brands or flavors. Other data filtering may be provided for the operator to view the data 1106 in a variety of ways.

Figure 12:
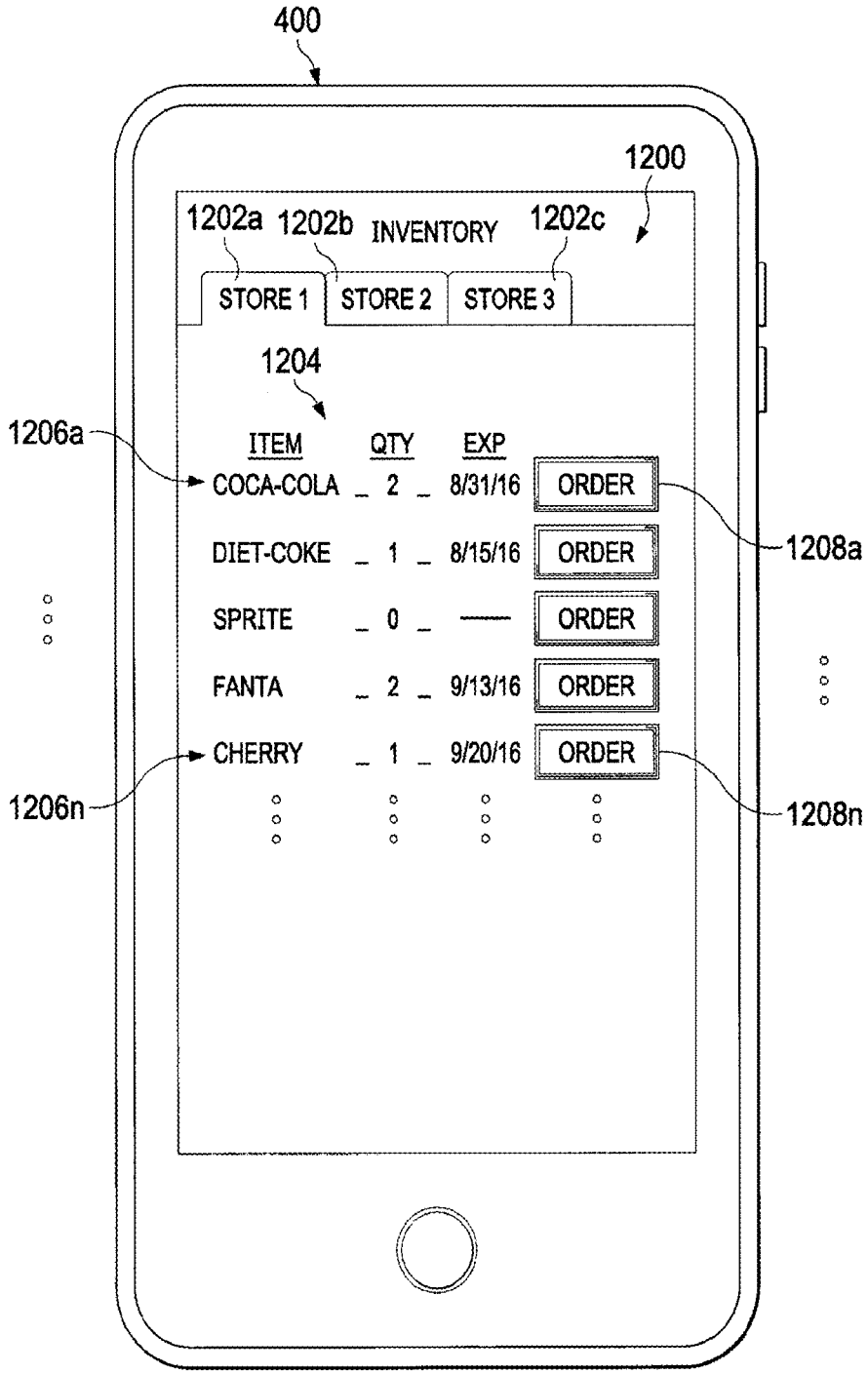
FIG. 12 is an illustration of the illustrative mobile electronic device on which an illustrative user interface may provide for inventory management and ordering.

With regard to FIG. 12, an illustration of the illustrative mobile electronic device 400 on which an illustrative user interface 1200 that provides for inventory management and ordering is shown. The user interface 1200 is shown to include multiple store tabs 1102*a*-1102*d* associated with different stores. Rather than using individual stores, geographic regions, such as geopolitical regions (e.g., blocks, towns, zip codes, cities, states, countries, etc.) may be available for an operator, such as a manager, or other user to select to view inventory data 1204. The inventory data 1204 may include items, quantity, expiration date, and/or other information for each data record 1206*a*-1206*n* (collectively 1206).

Associated with each of the data records 1206 may be an "Order" soft-button 1208*a*-1208*n* (collectively 1208) that may enable a user to order replacement ingredients. The ordering of replacement ingredients may be raw ingredients or packaged ingredients depending on the configuration of the dispenser. That is, if the dispenser is configured for cartridges of ingredients that are to be mixed with carbonated water, then the replacement ingredients may be ordered based on number of cartridges, number of cartons of a certain number of cartridges of the ingredients, a certain number of units (e.g., pounds, liters, etc.), and/or otherwise.

The quantity may indicate current inventory within the dispenser or currently available at a store. In an embodiment, the dispenser may be in communication with a server within a store or restaurant, and be able to access and share store inventory to a user, such as a store manager, so that the store manager may actively monitor and order replacement ingredients, as needed. The expiration date may be listed to allow the user to know whether additional store inventory usable on the current or as-needed date. Although not shown, projection data of projected inventory needs based on historical usage of the inventory may be provided. In one embodiment, rather than the user having to determine when to order and actively select the respective Order soft-buttons 1208, the mobile app (or server in communication with the mobile app) may calculate projected needs of the ingredients and provide a list of ingredients and project inventory needs for a certain time period (e.g., weekly, monthly), and present a list of ingredients along with the projected inventory needs for the user to accept, change, or reject. In selecting any of the Order soft-buttons 1208, additional information associated with an ingredient may be included, including a selectable quantity, anticipated delivery date, different flavors of a single brand, and so forth. In response to selecting any of the soft-buttons 1208 and submitting an order, either individually or in the aggregate, an order may be dispatched to a remote server, which may be at the store or at a centralized location (e.g., regional warehouse, 3rd party distributor, order fulfillment service provider, etc.).

In addition to store personnel or operators being able to authenticate and register with one or more dispensers, technicians who are charged with servicing and/or repairing dispensers may also be able to be authenticated and registered with one or more dispensers using a mobile electronic device for communication therewith. The technicians may work for a restaurant chain, retail chain, and/or be independent third-party contractors. In the case of technicians who have a route for servicing dispensers at different locations, the technicians may be authenticated and registered at each dispenser along the route. In an embodiment, a centralized network authentication and registration configuration may be utilized to enable the technician to be authenticated and registered at one location, and that information may be distributed from a central location to each of the dispensers assigned to the technician, thereby saving the technician time. Thereafter, when the technician with the electronic device is proximate any of the dispensers to which the authentication and registration information has been distributed, the dispenser or electronic device may automatically detect the electronic device and communications may automatically be initiated therebetween.

Figure 13A:
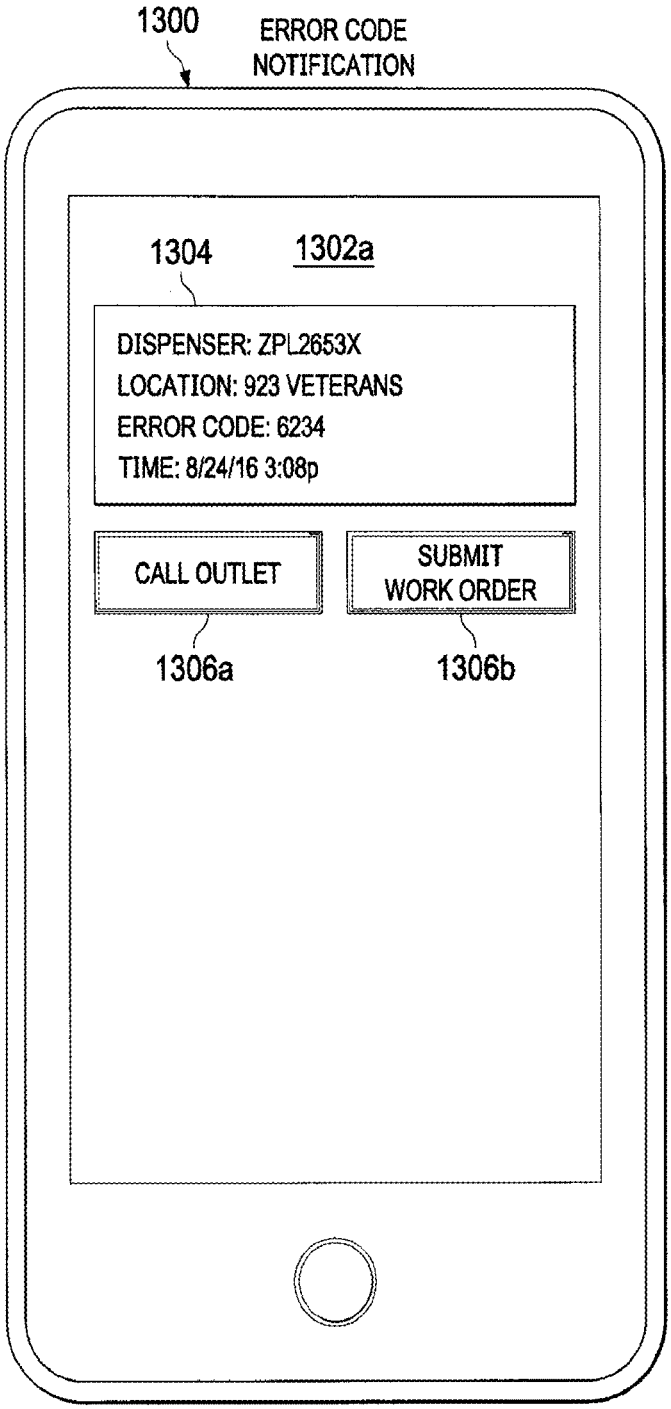
FIG. 13A is an electronic device (e.g., mobile phone) that may be used by a technician to communicate with one or more dispensers.

With regard to FIG. 13A, an electronic device 1300 (e.g., mobile phone) that may be used by a technician to communicate with one or more dispensers is shown. A user interface 1302*a*, such as one produced by a mobile app being executed by the electronic device 1300, may be used to present the technician with error notifications. The error notifications may include an error message 1304 that provides information associated with an error and/or other alert generated by a dispenser. In an embodiment, the error message 1304 may include a dispenser number, location, error code, time of message delivery, time of error, or any other information that may be useful to the technician for managing and maintaining dispensers. In an embodiment, the error message 1304 may be color-coded (e.g., background or text color may be varied), such that a routine maintenance message may be a first color (e.g., green), an important message may be a second color (e.g., yellow), and a critical failure error may be a third color (e.g., red).

As further shown, a "Call Outlet" soft-button 1306*a* and "Submit Work Order" soft-button 1306*b* may be displayed to enable the technician to call the outlet (e.g., store, restaurant, etc.) or submit a work order, respectively, by selecting either of the soft-buttons 1306*a* or 1306*b*. It should be understood that additional and/or alternative soft-buttons with different selectable options may be presented to the technician on the user interface 1302*a*. For example, an "I Can Handle" soft-button (not shown) may be selected to notify a home office, outlet manager, and/or other local technicians that the technician using the electronic device 1300 has time to respond to the error notification.

Figure 13B:
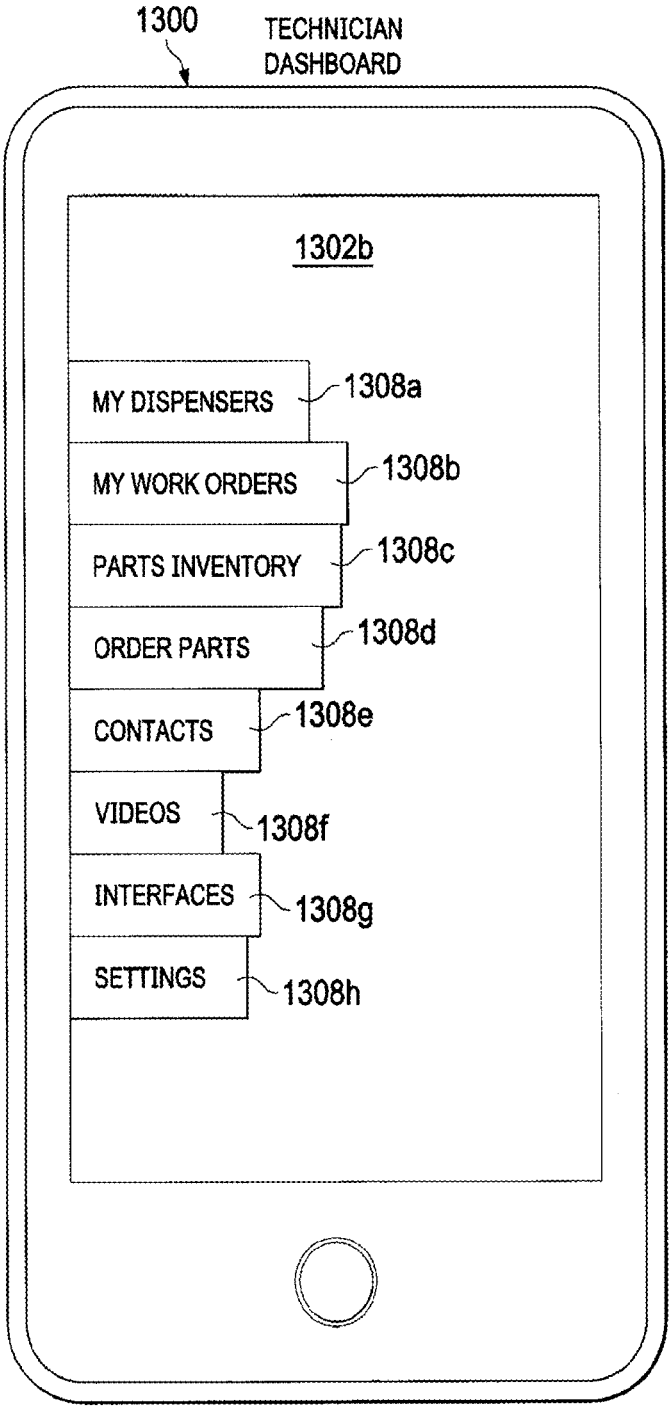
FIG. 13B is an illustration of an illustrative user interface 1302*b* that enables the technician to manage work on dispensers.

With regard to FIG. 13B, an illustration of an illustrative user interface 1302*b* that enables the technician to manage work on dispensers is shown. User interface 1302*b* may include a number of soft-buttons 1308*a*-1308*n* (collectively 1308). A "My Dispensers" soft-button 1308 may be selected to enable the technician to view a list of dispensers, including identifier, address, etc., that the technician services. The dispensers may be within a single organization or multiple organizations, and geographic locations and/or other information that describes the dispensers may be listed therewith. A "My Work Orders" soft-button 1308*b* may be selected to enable the technician to view work orders (e.g., see FIG. 13C) of which the technician is assigned. A "Parts Inventory" soft-button 1308*c* may be selected by the technician to view parts of dispensers that the technician may have on his or her truck or locally available in an inventory warehouse. An "order parts" soft-button 1308*d* may be selected by the technician to provide for ordering additional parts that the technician may need for performing his or her servicing of dispensers. A selectable listing of available spare parts may be presented to the technician on a separate screen. In addition, any parts that are currently on order and anticipated dates of receipt may be listed.

A "Contacts" soft-button 1308*e* may be selected to enable the technician to view his or her contacts. The contacts may be pre-populated for the technician, and include a listing of customers, tech-support, parts inventory, supervisor, or any other contacts that the technician may find helpful to perform his or her duties of servicing dispensers. The technician may further add contacts to the listing by entering information of a new contact or selecting from a contact list on the electronic device. A "Videos" soft-button 1308*f* may enable the user to view videos from a selectable list of available instructional videos that may be useful to the technician in performing repairs or maintenance on dispensers. In an embodiment, the videos may be available on another screen of the user interface, and be in the form of hyperlinks to link to a data repository at which the videos are stored or be previously downloaded videos. The data repository may be a private network address or public network address. An "Interfaces" soft-button 1308*g* may be selected by a user to view a number of different user interfaces that provide access to various other information associated with dispensers on which the technician services. The interfaces may include part specifications, functional operation of the dispensers, password management, authentication information, registration information, calendar, dispenser service route, scheduled maintenance listing, alerts listing, and/or any other information that may be useful for the technician. A "Settings" soft-button 1308*h* may be selected by the technician to set up a mobile app or other application used by the technician to manage his or her duties in maintaining and repairing dispensers.

Figure 13C:
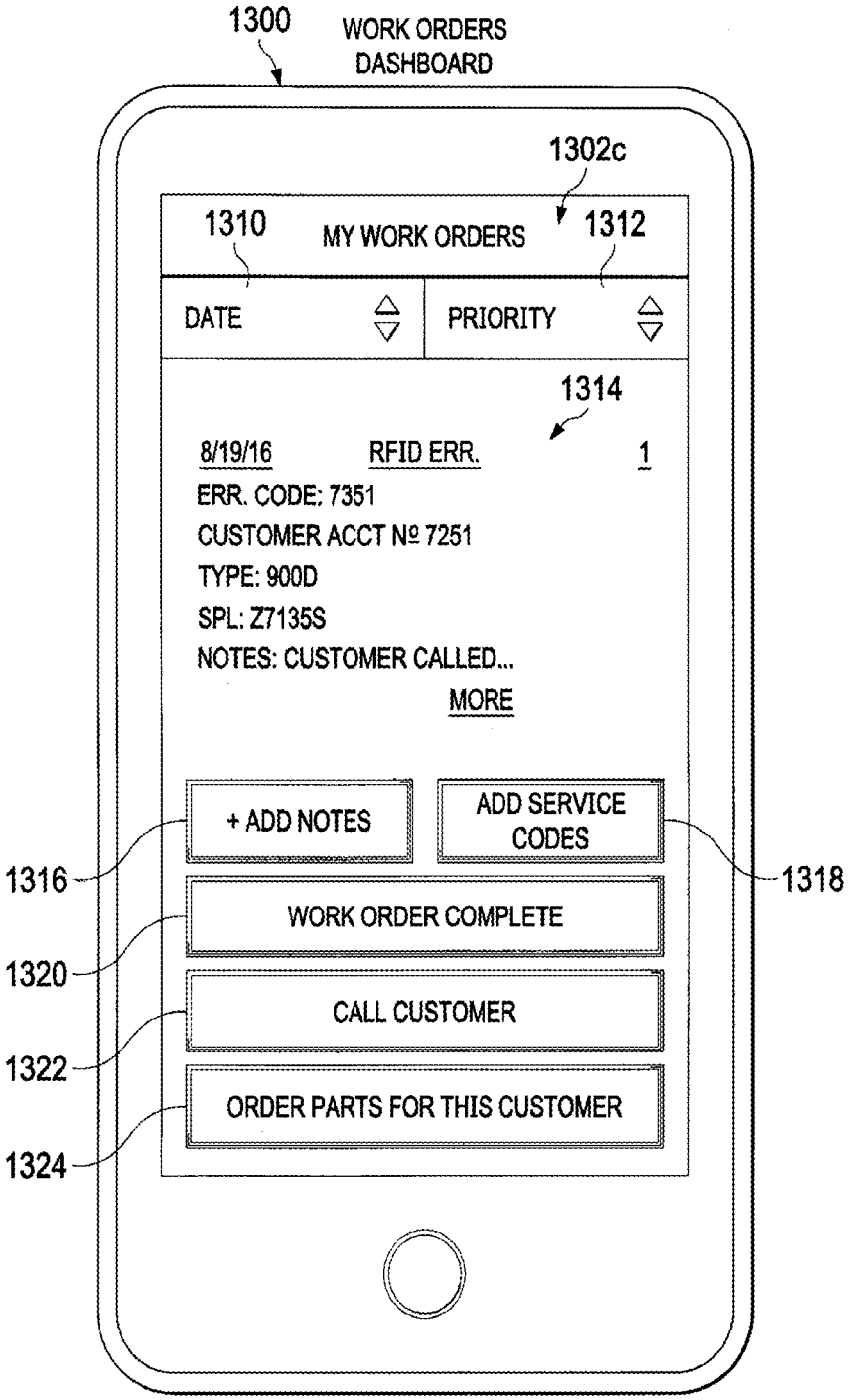
FIG. 13C is an illustration of an illustrative user interface of a "My Work Orders" dashboard.

With regard to FIG. 13C, an illustration of an illustrative user interface 1302*c* of a "My Work Orders" dashboard is shown. The user interface 1302*c* may include a selectable "Date" field 1310 and selectable "Priority" field 1312, where a technician may be able to change the date and priority. A work order information section 1314 may display a date, error type, number of errors, error code, customer account number, dispenser type, part number, notes, and any other information to assist the technician in performing a work order.

In addition, the user interface 1302*c* may include an "Add Notes" soft-button 1316 that allows the technician to add notes to the work order. An "Add Service Codes" soft-button 1318 may be selected by the technician to add detailed service codes that may include actual services performed when servicing the dispenser. The detailed service codes may be available via a network service, and accessible by the electronic device 1300.

A "Work Order Complete" soft-button 1320 may be selected by the technician to generate a work order complete signal (not shown) that indicates that the dispenser has been serviced and is complete. In an embodiment, any information added to the work order, such as notes, detailed service codes, or otherwise, may be uploaded to a central data repository. In another embodiment, the work order complete signal may cause a signal to be communicated directly or indirectly to the dispenser to clear the error at the dispenser. The dispenser may also include a "clear" mechanism (e.g., soft-button on a user interface) to clear the error.

In addition to the user being able to select the "Work Order Complete" soft-button 1320 to display his or her work orders, the mobile app being executed by the mobile device may be configured with GPS tracking system such that when the electronic device 1300 enters within a geo-fence (e.g., within 100 feet of a dispenser), the mobile app may request all work orders for the technician for the dispenser or a network server may be notified of the geo-location and communicate all work orders to the electronic device 1300 for the mobile app to automatically display for the technician. Rather than using a geo-fence, the mobile app may be triggered to request and/or receive work orders in response to a handshake occurring between the dispenser and the electronic device. Still yet, the mobile app may be triggered to request and/or receive work orders in response to a handshake occurring between a beacon at a facility in which the dispenser is located and the electronic device. The work orders may be presented as alerts using an operating system of the electronic device. In an embodiment, work orders that are listed by the mobile app may be reordered based on proximity of dispensers relative to the electronic device 1300. As an example, if the electronic device 1300 is in communication with a dispenser, all work orders for that dispenser may be listed first or may only be listed.

A "Call Customer" soft-button 1322 may be selected by the technician to call the customer, such as an operator of the dispenser. In an embodiment, when a work order is submitted, a phone number of the operator may be supplied, but not displayed or available to the technician due to the "Call Customer" soft-button 1322 being presented to the technician. An "Order Parts for This Customer" soft-button 1324 may be selected by the technician to order parts for the dispenser of the customer, and those parts and costs therefor may automatically be accounted for to the customer, thereby reducing back-end time and costs.

Figure 14:
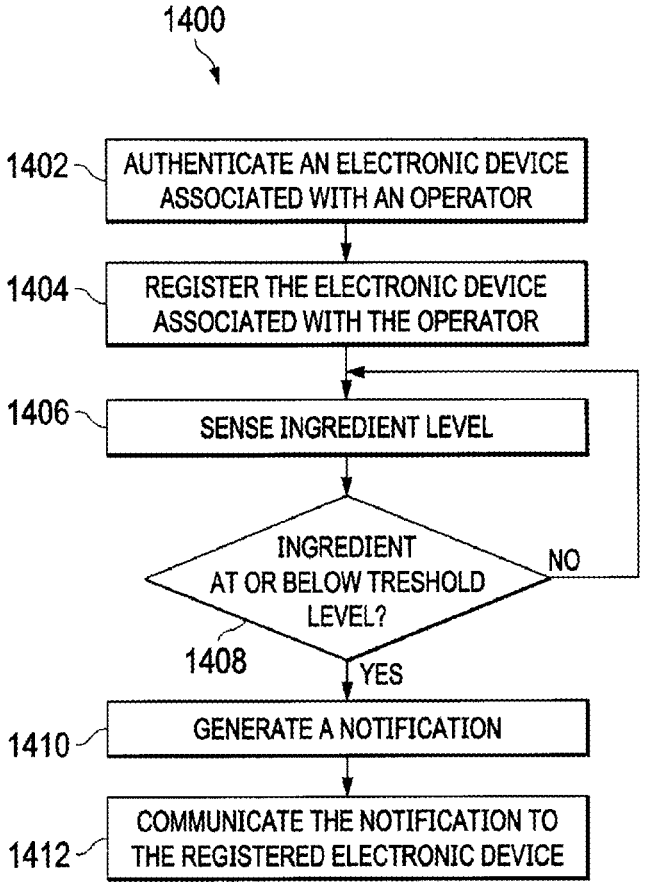
FIG. 14 is a flow diagram of an illustrative process for notifying an operator of ingredient information and dispenser operation.

With regard to FIG. 14, a flow diagram of an illustrative process 1400 for notifying an operator of ingredient information and dispenser operation is shown. As a precursor to the process 1400, a consumable ingredient used to produce consumable items by the dispenser may be stored. At step 1402, an electronic device associated with an operator may be authenticated. In authenticating the electronic device, the electronic device may communicate a user name, password, and/or any other information (e.g., encryption key) to the dispenser. At step 1404, the electronic device associated with the operator may be registered with the dispenser. In registering the electronic device, the operator may provide certain information to the dispenser via a user interface (e.g., mobile app) on the electronic device. At step 1406, an ingredient level may be sensed. The sensing of the ingredient level may be made using any number or combination of sensor types, as previously described.

At step 1408, a determination as to whether an amount of the ingredient in the ingredient storage unit is at or below a threshold level may be made. In an embodiment, the determination may be made in response to receiving a sensor signal indicative of an amount of ingredient remaining in the ingredient storage unit. The indication of the amount of ingredient remaining may be general (e.g., greater than a certain level, specific amount based on weight or volume, number of units remaining based on counts made since the ingredient was last replaced, and so forth). The sensor signal may include data that is looked up in a non-transitory memory of the dispenser, where the data may be set forth in weight, volume, units, counts, or otherwise and communicated as stored or converted into remaining amount of ingredient. At step 1410, in response to determining that a remaining amount of ingredient is at or below the threshold level, the processing unit may generate a notification indicative that the ingredient is at or below the threshold level. An operator may be identified to which to communicate the notification via the registered electronic device. At step 1412, the notification may be communicated to the registered electronic device associated with the identified operator via an input/output unit and over a communications network to notify the identified operator of the ingredient being at or below the threshold level.

It should be understood that additional and/or alternative notification options may be made available to an operator that relate to the dispenser functionality, operation, status, ingredients, operator access, and so forth, and have controllable notifications consistent with the other notification options. It should also be understood that the dispenser may be any other consumable item dispenser or vending machine. As examples, the consumable item dispensers may be candy vending machines, beverage can or bottle vending machines, and so on. Rather than measuring levels of ingredients in the vending machines, a count of remaining consumable items may be measured. Sensors may be configured to measure operational parameters, such as temperatures, lighting, and so on, and notifications may be generated and reported to operators in the same or similar manner. In the case of vending machines, however, operators tend to be in remote locations from the vending machines, so other rules for determining which operators to communicate the notifications may be used. As an example, an operator status (e.g., occupied, available) and/or distance from the vending machine may be used by the vending machine (or scheduler on network server) for determining to which operator a notification is to be sent. The use of the principles described herein may reduce downtime, provide for customization of a dispenser, provide for key data to a store or restaurant based on top brands, times of spike for sales and number of drinks or other consumable items consumed, and so on.

The foregoing method descriptions and the process flow diagrams are provided merely as illustrative examples and are not intended to require or imply that the steps of the various embodiments must be performed in the order presented. As will be appreciated by one of skill in the art, the steps in the foregoing embodiments may be performed in any order. Words such as "then," "next," etc. are not intended to limit the order of the steps; these words are simply used to guide the reader through the description of the methods. Although process flow diagrams may describe the operations as a sequential process, many of the operations may be performed in parallel or concurrently. In addition, the order of the operations may be re-arranged. A process may correspond to a method, a function, a procedure, a subroutine, a subprogram, etc. When a process corresponds to a function, its termination may correspond to a return of the function to the calling function or the main function.

The various illustrative logical blocks, modules, circuits, and algorithm steps described in connection with the embodiments disclosed here may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

Embodiments implemented in computer software may be implemented in software, firmware, middleware, microcode, hardware description languages, or any combination thereof. A code segment or machine-executable instructions may represent a procedure, a function, a subprogram, a program, a routine, a subroutine, a module, a software package, a class, or any combination of instructions, data structures, or program statements. A code segment may be coupled to and/or in communication with another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

The actual software code or specialized control hardware used to implement these systems and methods is not limiting of the invention. Thus, the operation and behavior of the systems and methods were described without reference to the specific software code being understood that software and control hardware can be designed to implement the systems and methods based on the description here.

When implemented in software, the functions may be stored as one or more instructions or code on a non-transitory computer-readable or processor-readable storage medium. The steps of a method or algorithm disclosed here may be embodied in a processor-executable software module which may reside on a computer-readable or processor-readable storage medium. A non-transitory computer-readable or processor-readable media includes both computer storage media and tangible storage media that facilitate transfer of a computer program from one place to another. A non-transitory processor-readable storage media may be any available media that may be accessed by a computer. By way of example, and not limitation, such non-transitory processor-readable media may comprise RAM, ROM, EEPROM. CD-ROM or other optical disk storage, magnetic disk storage or other magnetic storage devices, or any other tangible storage medium that may be used to store desired program code in the form of instructions or data structures and that may be accessed by a computer or processor. Disk and disc, as used here, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a non-transitory processor-readable medium and/or computer-readable medium, which may be incorporated into a computer program product.

The previous description is of a preferred embodiment for implementing the invention, and the scope of the invention should not necessarily be limited by this description. The scope of the present invention is instead defined by the following claims.

The invention claimed is:

1. A system comprising:

a mobile electronic device configured to receive data via a communications channel from a dispenser, the mobile electronic device associated with an operator authorized to service the dispenser; and a mobile application executing on the mobile electronic device, the mobile application configured to:

receive authentication data to authenticate the operator as being authorized to service the dispenser;

receive, from the dispenser via the communications channel responsive to authentication of the operator as being authorized to service the dispenser, one or more data messages indicative of available beverages being offered to be dispensed by the dispenser and current levels of ingredients for producing the available beverages; and display data indicating the current levels of ingredients for producing the available beverages being offered to be dispensed by the dispenser.

2. The system according to claim 1, wherein the mobile electronic device is further configured to:

communicate an authentication signal to the dispenser; and communicate, after an authentication process, a registration signal to the dispenser.

3. The system according to claim 2, wherein the mobile application is further configured to receive information from an operator during a registration process.

4. The system according to claim 3, wherein the mobile electronic device is further configured to automatically communicate with the dispenser when within local communication or a geographic proximity of the dispenser responsive to registering with the dispenser.

5. The system according to claim 4, wherein the mobile electronic device is further configured to receive a digital cookie from the dispenser indicating that the mobile electronic device is authenticated and registered with the dispenser.

6. The system according to claim 1, wherein the mobile application is further configured to receive a notification from the dispenser, and present the notification to a user of the mobile electronic device.

7. The system according to claim 1, wherein the mobile application is further configured to provide one or more options on a user interface for receiving notifications, the one or more options comprising at least one of a sold out option, a software option, a nightly job option, a work order received option, a repair completed option, a boil water alert option, a content update option, or a recipe poured option.

8. The system according to claim 1, wherein the mobile application is further configured to generate a notification indicating that an ingredient for an available beverage needs to be replaced based on the data.

9. The system according to claim 1, wherein the data messages include data indicative of ingredients having a level below a threshold level.

10. The system according to claim 1, wherein the mobile application is further configured to display a user interface including a pour history or consumption history for the beverage dispenser.

11. The system according to claim 1, wherein the mobile application is further configured to display a user interface for inventory management and ordering, the user interface including one or more soft-buttons for ordering replacement ingredients.

12. A method comprising:

receiving, by a mobile electronic device executing a mobile application via a communications channel from a dispenser, authentication data to authenticate an operator associated with the mobile electronic device as being authorized to service the dispenser;

receiving, by the mobile electronic device via the communications channel from the dispenser responsive to authentication of the operator as being authorized to service the dispenser, one or more data messages indicative of available beverages being offered to be dispensed by the dispense and current levels of ingredients for producing the available beverages; and displaying, by the mobile application, data illustrating the current levels of ingredients being offered to be dispensed by the dispenser.

13. The method according to claim 12, further comprising displaying, by the mobile application, a user interface including a pour history or consumption history for the beverage dispenser.

14. The method according to claim 12, further comprising displaying, by the mobile application, a user interface for inventory management and ordering, the user interface including one or more soft-buttons for ordering replacement ingredients.

15. The method according to claim 12, further comprising generating, by the mobile application, a notification indicating that an ingredient for an available beverage needs to be replaced based on the data.

16. The method according to claim 12, further comprising:

communicating, by the mobile electronic device, an authentication signal to the dispenser; and communicating, after an authentication process, a registration signal to the dispenser.

17. The method according to claim 16, further comprising receiving, by the mobile electronic device, information from an operator during a registration process.

18. The method according to claim 17, further comprising automatically communicating, by the mobile electronic device, one or more signals with the dispenser when within local communication or a geographic proximity of the dispenser responsive to registering with the dispenser.

19. The method of claim 18, further comprising receiving, by the mobile electronic device, a digital cookie from the dispenser indicating that the mobile electronic device is authenticated and registered with the dispenser.

20. The method of claim 12, further comprising providing, by the mobile applications, one or more options on a user interface for receiving notifications, the one or more options comprising at least one of a sold out option, a software option, a nightly job option, a work order received option, a repair completed option, a boil water alert option, a content update option, or a recipe poured option.

* * * * *